US009345087B2

(12) United States Patent
Yu et al.

(10) Patent No.: US 9,345,087 B2
(45) Date of Patent: May 17, 2016

(54) AC-POWERED LED LIGHT ENGINES, INTEGRATED CIRCUITS AND ILLUMINATING APPARATUSES HAVING THE SAME

(71) Applicant: Groups Tech Co., Ltd., Taipei (TW)

(72) Inventors: Ching Sheng Yu, New Taipei (TW); Chih Liang Wang, Keelung (TW); Kuang Hui Chen, New Taipei (TW)

(73) Assignee: Groups Tech Co., Ltd., Taipei (TW)

( * ) Notice: Subject to any disclaimer, the term of this patent is extended or adjusted under 35 U.S.C. 154(b) by 0 days.

(21) Appl. No.: 14/566,633

(22) Filed: Dec. 10, 2014

(65) Prior Publication Data

US 2015/0163875 A1 Jun. 11, 2015

Related U.S. Application Data

(63) Continuation-in-part of application No. 14/164,236, filed on Jan. 26, 2014, now Pat. No. 9,107,264.

(30) Foreign Application Priority Data

Dec. 11, 2013 (TW) ..... 102145709 A
Apr. 29, 2014 (TW) ..... 103115395 A

(51) Int. Cl.
*G05F 1/00* (2006.01)
*H05B 33/08* (2006.01)

(52) U.S. Cl.
CPC ..... *H05B 33/083* (2013.01)

(58) Field of Classification Search
CPC ..... H05B 33/0815
USPC ..... 315/185 R, 312, 291, 307, 160, 170, 246
See application file for complete search history.

(56) References Cited

U.S. PATENT DOCUMENTS

| | | | | |
|---|---|---|---|---|
| 2008/0116818 | A1* | 5/2008 | Shteynberg et al. | 315/192 |
| 2010/0134018 | A1* | 6/2010 | Tziony et al. | 315/122 |
| 2011/0068702 | A1* | 3/2011 | van de Ven et al. | 315/186 |
| 2013/0169159 | A1* | 7/2013 | Lys | 315/122 |
| 2013/0200802 | A1* | 8/2013 | Sakuragi et al. | 315/122 |

* cited by examiner

*Primary Examiner* — Minh D A

(57) ABSTRACT

An ac-powered LED light engine coupled between a rectifier and a plurality of extrinsic LED sub-arrays is provided. The ac-powered LED light engine comprises a plurality of normally closed bypass switches, a normally closed current regulator, and a plurality of switch controllers. Each of the normally closed bypass switches is connected in parallel with a corresponding LED sub-array except for the topmost or the bottommost LED sub-array and shuttles between three switch states: ON, REGULATION, and OFF. The normally closed current regulator is coupled to the normally closed bypass switches and used to regulate the highest LED current level near the peak of an extrinsic mains voltage. Each of the switch controllers is coupled to a corresponding bypass switch as a feedback network and takes control of the three switch states according to a corresponding current sense signal.

19 Claims, 11 Drawing Sheets

6

8

AC-POWERED LED LIGHT ENGINES, INTEGRATED CIRCUITS AND ILLUMINATING APPARATUSES HAVING THE SAME

CROSS-REFERENCE TO RELATED APPLICATIONS

This application is a continuation-in-part (CIP) of U.S. patent application Ser. No. 14/164,236, filed Jan. 26, 2014, the disclosures of which are fully incorporated herein by reference. This application claims the benefits of TW 102145709, filed Dec. 11, 2013, and TW 103115395, filed Apr. 29, 2014, all of which are fully incorporated herein by reference.

BACKGROUND OF THE INVENTION

1. Field of the Invention

The present invention relates to an ac-powered LED light engine to gear up and down the number and current of excited LED sub-arrays in accordance with the voltage level of the rectified sinusoidal input voltage.

2. Description of the Prior Art

LED-based lighting devices are gradually becoming the preferred lighting equipment because of having a relatively longer lifetime to reduce maintaining cost, and being less likely to get damaged.

Technically, LEDs need to be DC-driven. So, an AC sinusoidal input voltage would normally be rectified by a full-wave or a half-wave rectifier into a rectified sinusoidal input voltage before coming into use. In the vicinity of the beginning and end of each DC pulse cycle (aka "dead time") where the input voltage is less than the combined forward voltage drop of the LEDs, the LEDs cannot be forward-biased to light up. The dead time in union with the conduction angle constitutes a full period of the rectified sinusoidal input voltage. A longer dead time translates to a smaller conduction angle, and hence a lower power factor because the line current is getting too thin to be similar in shape to the line voltage. Traditional LED drivers usually come along with three application problems.

The first problem would be the need for a more complicated and more expensive driving circuit consisting of a filter, a rectifier, a power factor corrector (PFC), etc. to drive LEDs. The short-life electrolytic capacitor used as an energy-storage component in the PFC is the key reason accounting for the shortened overall lifespan of the whole LED illuminating apparatus, cancelling out the virtues of LED lighting.

The second problem would be the flicker phenomenon due to no current flow through the LEDs during the dead time. The LEDs would immediately light up with a positive driving current, and immediately go out with a zero driving current, causing the LEDs to flicker if there exists a dead time. The flicker phenomenon takes place during the dead time at a repetition rate of twice the AC sinusoidal frequency.

The third problem would be a relatively lower power factor exhibited by a low-power PFC with a loop current too weak to be precisely sensed to correctly shape the AC input current into a sinusoidal waveform. The power factor is used to measure the electricity utilization. The more similar the line current is to the line voltage, the better the electricity utilization and the higher the power factor. When the line current and the line voltage are consistent in terms of identical phase and identical shape, the power factor would reach its maximum value of 1.

The conventional PFC needs to sense its loop current for the purpose of aligning the line current with the line voltage. If the loop current appears too low to be precisely sensed by the current-sensing circuitry in the PFC stage, the PFC would fail to properly keep the line current in phase and in shape with the line voltage to achieve a high power factor. Often mentioned in the same breath with the issue of a low PF is the issue of a high total harmonic distortion (THD). According to the theory of Fourier series expansion of any periodic signal, any discontinuous or jumping points in the periodic waveform would incur higher-order harmonics on top of the fundamental component, causing the THD to increase. The THD resulting from the discontinuous or jumping points in the AC input current waveform would have much to do with the existence of the dead time.

Simplifying the electronic circuit, reducing the manufacturing and maintaining costs, eliminating the flicker phenomenon, as well as improving the power factor still remain the main topics put at the top of the agenda when it comes to developing new-generation LED lighting apparatuses.

SUMMARY OF THE INVENTION

The present invention is directed to an ac-powered LED light engine to gear up and down the number and current of excited LED sub-arrays in accordance with the voltage level of the rectified sinusoidal input voltage. If further equipped with the option of disclosed flicker-suppressing capacitors, the disclosed ac-powered LED light engines could improve the flicker phenomenon while maintaining exactly the same high PF and exactly the same low THD without any deterioration.

In one aspect, the present invention provides ac-powered LED light engines, coupled between a rectifier and a plurality of extrinsic LED sub-arrays as well as comprising a plurality of normally closed bypass switches, a normally closed current regulator, and a plurality of switch controllers. Each of the normally closed bypass switches is connected in parallel with a corresponding LED sub-array except for the topmost or the bottommost LED sub-array and shuttles between three switch states: ON, REGULATION, and OFF. The normally closed current regulator is coupled to the normally closed bypass switches and used to regulate the highest LED current level near the peak of an extrinsic mains voltage. Each of the switch controllers is coupled to a corresponding normally closed bypass switch as a feedback network and takes control of the three switch states according to a corresponding current sense signal.

In another aspect, the present invention provides integrated circuits, comprising any form of the aforementioned ac-powered LED light engines, as workhorses for driving illuminating apparatuses.

In still another aspect, the present invention provides illuminating apparatuses, comprising a rectifier coupled to an AC mains for providing a rectified sinusoidal voltage, and an ac-powered LED light engine. The ac-powered LED light engine is coupled between the rectifier and a plurality of extrinsic LED sub-arrays. The ac-powered LED light engine comprises a plurality of normally closed bypass switches, each connected in parallel with a corresponding LED sub-array except for the topmost or the bottommost LED sub-array and shuttling between three switch states: ON, REGULATION, and OFF; a normally closed current regulator coupled to the normally closed bypass switches and used to regulate the highest LED current level near the peak of an extrinsic mains voltage; a plurality of current-sensing resistors connected to a plurality of extrinsic LED sub-arrays; and a plurality of switch controllers each coupled between a corresponding current-sensing resistor or a corresponding current sense tap and a corresponding bypass switch as a feedback network and taking control of the three switch states according to a corresponding current sense signal.

BRIEF DESCRIPTION OF THE DRAWINGS

The foregoing conceptions and their accompanying advantages of the present invention will get more readily appreciated after being better understood by referring to the following detailed description, in conjunction with the accompanying drawings, wherein.

DESCRIPTION OF THE PREFERRED EMBODIMENT

The detailed explanation of the present invention is described as follows. The preferred embodiments are presented for purposes of illustrations and description, and not intended to limit the scope of the present invention.

Figure 1A:
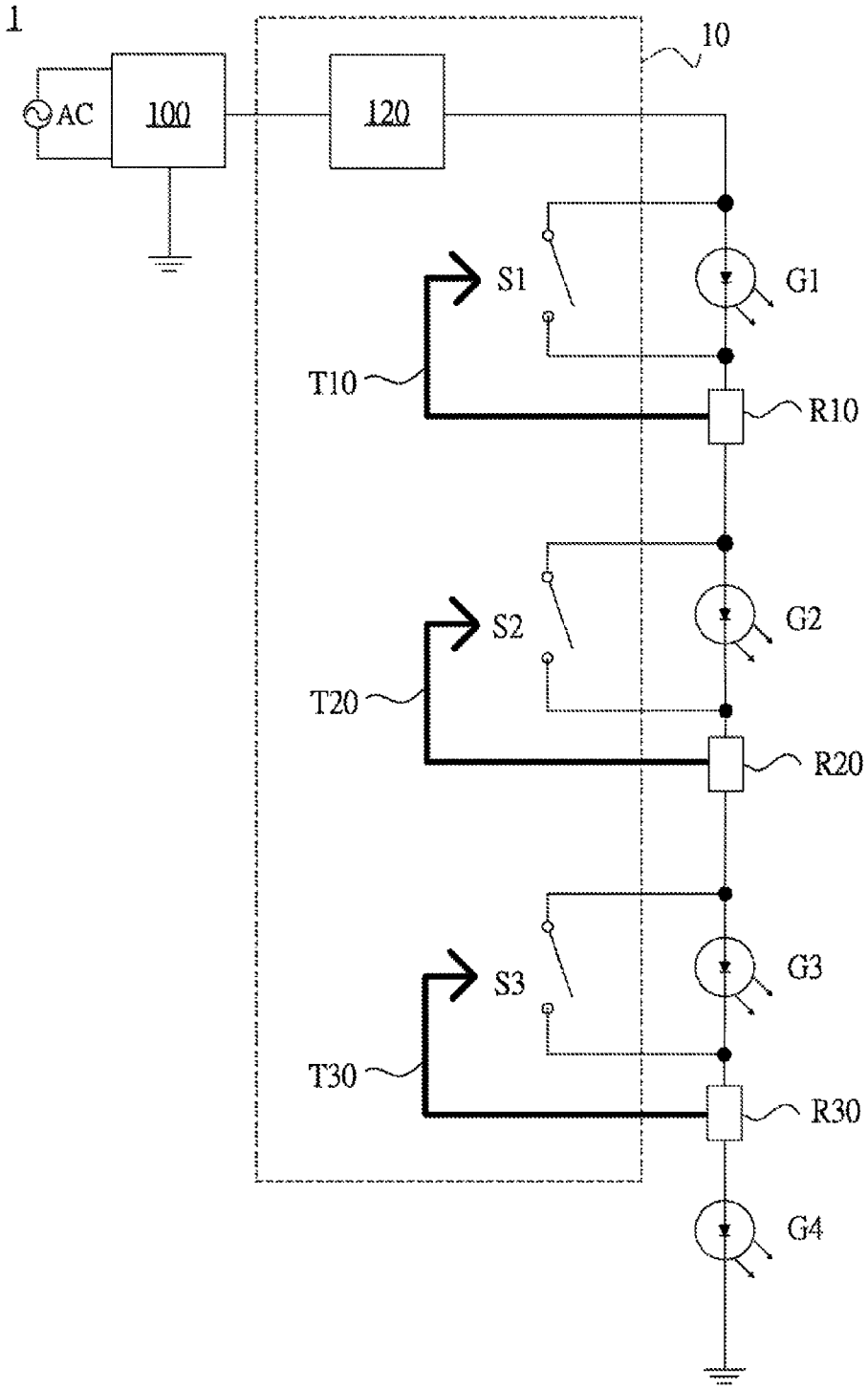
FIG. 1A illustrates a block diagram of an illuminating apparatus 1 equipped with an ac-powered LED light engine 10 designed to gear up from the bottom up and gear down from the top down the interspersed LED sub-arrays G1, G2, G3, and G4 according to an embodiment of the present invention.

FIG. 1A illustrates a block diagram of an illuminating apparatus 1 equipped with an ac-powered LED light engine 10 designed to gear up from the bottom up and gear down from the top down the interspersed LED sub-arrays (G1, G2, G3, and G4) according to an embodiment of the present invention. The illuminating apparatus 1 comprises a rectifier 100 coupled to an AC mains, an ac-powered LED light engine 10, and a plurality of current-sensing resistors (R10, R20, and R30), and is equipped with a plurality of extrinsic LED sub-arrays (G1, G2, G3, and G4).

The ac-powered LED light engine 10 is coupled between the rectifier 100 and the interspersed LED sub-arrays (G1, G2, G3, and G4), and has a normally closed current regulator 120 coupled to the rectifier 100 through its high-side terminal and used to regulate the highest LED current level near the rectified sinusoidal input voltage peak, a plurality of normally closed bypass switches (S1, S2, and S3) each connected in parallel with a corresponding LED sub-array except for the bottommost LED sub-array G4 and shuttling between three switch states: ON, REGULATION, and OFF according to a corresponding current sense signal, and a plurality of switch controllers (T10, T20, and T30) each coupled between a corresponding current-sensing resistor and a corresponding bypass switch as a feedback network and taking control of the three switch states.

The rectifier 100 could be but will not be limited to a full-wave or a half-wave rectifier. Each of the normally closed bypass switches S1, S2, and S3 could be but will not be limited to an enhancement-mode or a depletion-mode n-channel Metal Oxide Semiconductor Field Effect Transistor (MOSFET) in collocation with an adequate switch controller. Each of the switch controllers T10, T20, and T30 could be but will not be limited to a Bipolar Junction Transistor (BJT)-based, a Shunt Regulator (SR)-based, or a Photo Coupler (PC)-based gate-driving circuit in control of the three switch states. The switch controllers T10, T20, and T30, assumed for simplification, not for limitation, to have exactly the same reference voltage $V_{REF}$ used for comparison with the current sense signals, respectively rule over the three switch states of the normally closed bypass switches S1, S2, and S3 according to the sensed voltages across the mutually independent current-sensing resistors R10, R20, and R30. A downstream current-sensing resistor has a larger resistance than an upstream one (R30>R20>R10), and the unshown current-sensing resistor in the normally closed current regulator 120 has the smallest resistance as compared with the current-sensing resistors R10, R20, and R30.

Figure 2:
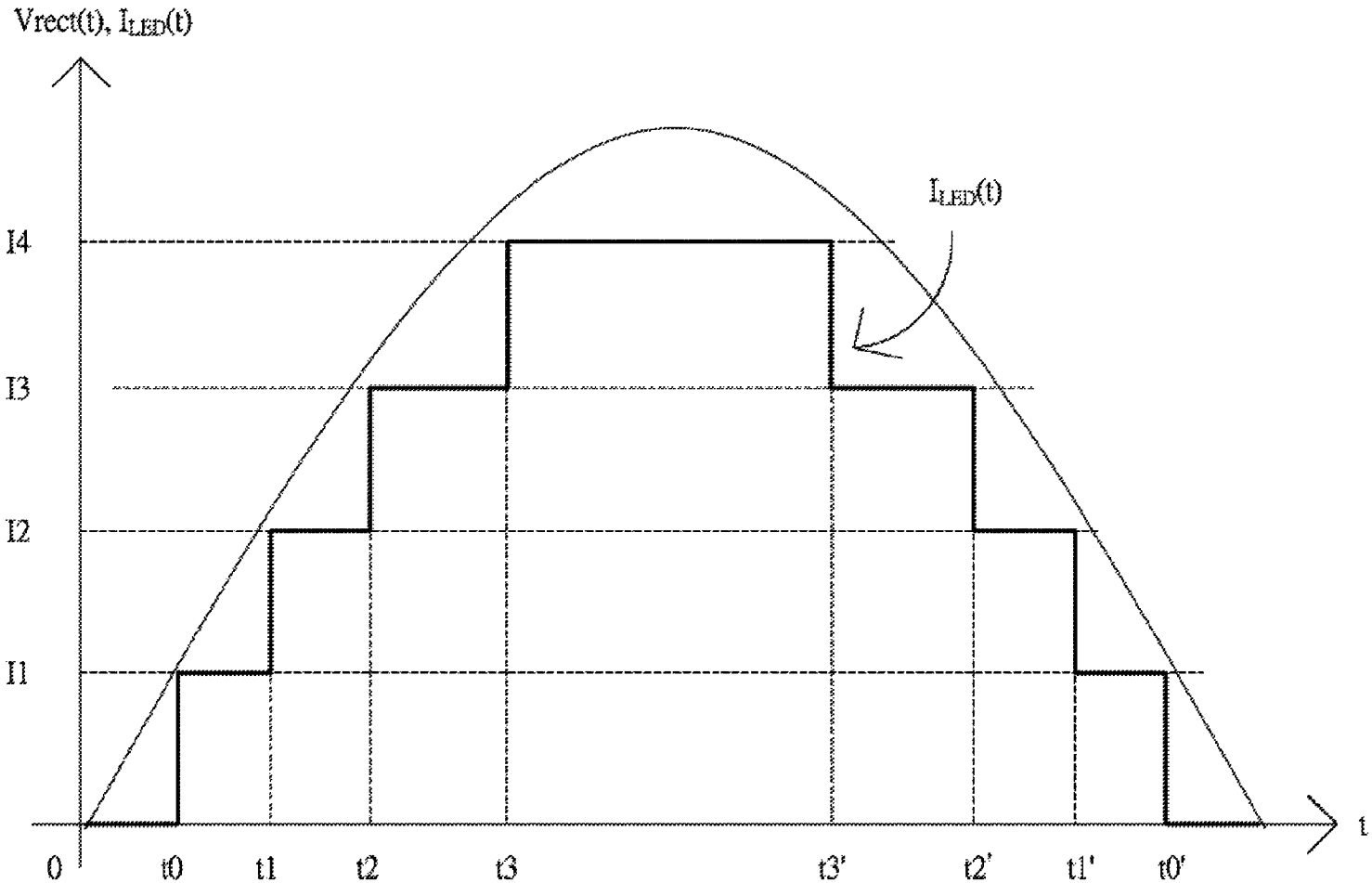
FIG. 2 illustrates two waveform diagrams showing the shaped LED current in response to the rectified sinusoidal input voltage as the disclosed ac-powered LED light engine gears up and down the segmented LED sub-arrays within a period according to preferred embodiments of the present invention.

Please cross-refer to FIGS. 1A and 2. During the first half of the period, the rectified sinusoidal input voltage goes up to its peak from zero. When the rising input voltage (vi) is still less than the forward voltage drop of the bottommost LED sub-array G4 ($0 \le vi < V_{G4}$), no current flows into the circuit and this interval ($0 \le t < t_0$) is commonly called the dead time. When the rising input voltage (vi) has been high enough to forward-bias the LED sub-array G4 but is still less than the combined forward voltage drop of the LED sub-arrays G3 and G4 ($V_{G4} \le vi < V_{G3+G4}$), a constant current I1, flowing downstream through the normally closed current regulator 120, the normally closed bypass switch S1, the current-sensing resistor R10, the normally closed bypass switch S2, the current-sensing resistor R20, the current-regulating bypass switch S3, and the current-sensing resistor R30 as well as regulated by the bypass switch S3 through the switch controller T30, lights up the LED sub-array G4 during the interval of ($t_0 \le t < t_1$).

The constant current I1 would be regulated by the bypass switch S3 through the switch controller T30 according to the design formula I1×R30=$V_{REF}$, i.e.

$$I1 = \frac{V_{REF}}{R30}.$$

If the constant current I1 goes above its preset current level $$\frac{V_{REF}}{R30},$$

the switch controller T30 turns off the bypass switch S3 for the constant current I1 to go down to $$\frac{V_{REF}}{R30}.$$

If the constant current I1 goes below its preset current level $$\frac{V_{REF}}{R30},$$

the switch controller T30 turns on the bypass switch S3 for the constant current I1 to go up to $$\frac{V_{REF}}{R30}.$$

That is to say, the switch controller T30 detects an at-reference current sense signal from the current-sensing resistor R30 (I1×R30=$V_{REF}$), so the bypass switch S3 gets into its REGULATION state to regulate the LED current flowing through the downstream LED sub-array G4 at a constant current level I1 preset with the resistance of current-sensing resistor R30

$$\left(I1 = \frac{V_{REF}}{R30}\right).$$

The switch controllers T10 and T20 each detect a below-reference current sense signal from the current-sensing resistors R10 and R20 respectively (I1×R10<I1×R20<$V_{REF}$), so the normally closed bypass switches S1 and S2 remain in their ON state to short out the LED sub-arrays G1 and G2.

When the rising input voltage (vi) has been high enough to forward-bias the combined LED sub-arrays G3 and G4 but is still less than the combined forward voltage drop of the LED sub-arrays G2, G3, and G4 ($V_{G3+G4}$≤vi<$V_{G2+G3+G4}$), a constant current I2 lights up the LED sub-arrays G3 and G4 during the interval of ($t_1$≤t<$t_2$). The switch controller T30 detects an above-reference current sense signal from the current-sensing resistor R30 (I2×R30>$V_{REF}$), so the bypass switch S3 stays in its OFF state to free up the LED sub-array G3. The constant current I2 would be regulated by the bypass switch S2 through the switch controller T20 according to the design formula I2×R20=$V_{REF}$, i.e.

$$I2 = \frac{V_{REF}}{R20}.$$

That is to say, the switch controller T20 detects an at-reference current sense signal from the current-sensing resistor R20 (I2×R20=$V_{REF}$), so the bypass switch S2 gets into its REGULATION state to regulate the LED current flowing through the downstream LED sub-arrays G3 and G4 at a constant current level I2 preset with the resistance of current-sensing resistor R20

$$\left(I2 = \frac{V_{REF}}{R20}\right).$$

The switch controller T10 detects a below-reference current sense signal from the current-sensing resistor R10 (I2×R10<$V_{REF}$), so the normally closed bypass switch S1 remains in its ON state to short out the LED sub-array G1.

When the rising input voltage (vi) has been high enough to forward-bias the combined LED sub-arrays G2, G3, and G4 but is still less than the combined forward voltage drop of the LED sub-arrays G1, G2, G3, and G4 ($V_{G2+G3+G4}$≤vi<$V_{G1+G2+G3+G4}$), a constant current I3 lights up the LED sub-arrays G2, G3, and G4 during the interval of ($t_2$≤t<$t_3$). The constant current I3 would be regulated by the bypass switch S1 through the switch controller T10 according to the design formula I3×R10=$V_{REF}$, $$\text{i.e. } I3 = \frac{V_{REF}}{R10}.$$

That is to say, the switch controller T10 detects an at-reference current sense signal from the current-sensing resistor R10 (I3×R10=$V_{REF}$), so the bypass switch S1 gets into its REGULATION state to regulate the LED current flowing through the downstream LED sub-arrays G2, G3, and G4 at a constant current level I3 preset with the resistance of R10

$$\left(I3 = \frac{V_{REF}}{R10}\right).$$

The switch controllers T20 and T30 each detect an above-reference current sense signal from the current-sensing resistors R20 and R30 respectively (I3×R30>I3×R20>$V_{REF}$), so the bypass switches S2 and S3 stay in their OFF state to free up the LED sub-arrays G2 and G3.

When the input voltage (vi) is high enough to forward-bias all of the LED sub-arrays G1, G2, G3, and G4 ($V_{G1+G2+G3+G4}$≤vi), a constant current I4 preset with an unshown current-sensing resistor in the normally closed current regulator 120 lights up the LED sub-arrays G1, G2, G3, and G4 in the vicinity of the peak of the rectified sinusoidal input voltage ($t_3$≤t<$t_{3'}$). The aforementioned constant current levels are ranked in the order of I4>I3>I2>I1 for an active bypass switch to deactivate its downstream bypass switches, calling for the sequence of R30>R20>R10. In this way, the ac-powered LED light engine 10 gears up each LED sub-array from the bottom up.

During the second half of the period, the rectified sinusoidal input voltage goes down to zero from its peak. When the falling input voltage (vi) is still high enough to forward-bias the combined LED sub-arrays G2, G3, and G4 but has been less than the combined forward voltage drop of the LED sub-arrays G1, G2, G3, and G4 ($V_{G2+G3+G4} \leq vi < V_{G1+G2+G3+G4}$), the switch controller T10 detects an at-reference current sense signal from the current-sensing resistor R10 ($I3 \times R10 = V_{REF}$), so the bypass switch S1 gets into its REGULATION state to regulate the LED current flowing through the downstream LED sub-arrays G2, G3, and G4 at the preset constant current level I3 during the interval of ($t_{3'} \leq t < t_{2'}$). The switch controllers T20 and T30 each detect an above-reference current sense signal from the current-sensing resistors R20 and R30 respectively ($I3 \times R30 > I3 \times R20 > V_{REF}$), so the bypass switches S2 and S3 stay in their OFF state to free up the LED sub-arrays G2 and G3.

When the falling input voltage (vi) is still high enough to forward-bias the combined LED sub-arrays G3 and G4 but has been less than the combined forward voltage drop of the LED sub-arrays G2, G3, and G4 ($V_{G3+G4} \leq vi < V_{G2+G3+G4}$), the switch controller T30 detects an above-reference current sense signal from the current-sensing resistor R30 ($I2 \times R30 > V_{REF}$), so the bypass switch S3 stays in its OFF state to free up the LED sub-array G3 during the interval of ($t_{2'} \leq t < t_{1'}$). The switch controller T20 detects an at-reference current sense signal from the current-sensing resistor R20 ($I2 \times R20 = V_{REF}$), so the bypass switch S2 gets into its REGULATION state to regulate the LED current flowing through the downstream LED sub-arrays G3 and G4 at the preset constant current level I2. The switch controller T10 detects a below-reference current sense signal from the current-sensing resistor R10 ($I2 \times R10 < V_{REF}$), so the normally closed bypass switch S1 goes back to its ON state to short out the LED sub-array G1.

When the falling input voltage (vi) is still high enough to forward-bias the LED sub-array G4 but has been less than the combined forward voltage drop of the LED sub-arrays G3 and G4 ($V_{G4} \leq vi < V_{G3+G4}$), the switch controller T30 detects an at-reference current sense signal from the current-sensing resistor R30 ($I1 \times R30 = V_{REF}$), so the bypass switch S3 gets into its REGULATION state to regulate the LED current flowing through the downstream LED sub-array G4 at the preset constant current level I1 during the interval of ($t_{1'} \leq t < t_{0'}$). The switch controllers T10 and T20 each detect a below-reference current sense signal from the current-sensing resistors R10 and R20 respectively ($I2 \times R10 < I2 \times R20 < V_{REF}$), so the normally closed bypass switches S1 and S2 go back to their ON state to short out the LED sub-arrays G1 and G2. In this way, the ac-powered LED light engine 10 gears down each LED sub-array from the top down till all of the LED sub-arrays go out. The number of the aforementioned constant current levels for the ac-powered LED light engine 10, translating to the number of the bypass switches and the switch controllers devised to draw a quasi-sinusoidal line current waveform from the AC sinusoidal line voltage source, could be arbitrarily chosen with a design tradeoff between performance and cost.

Figure 1B:
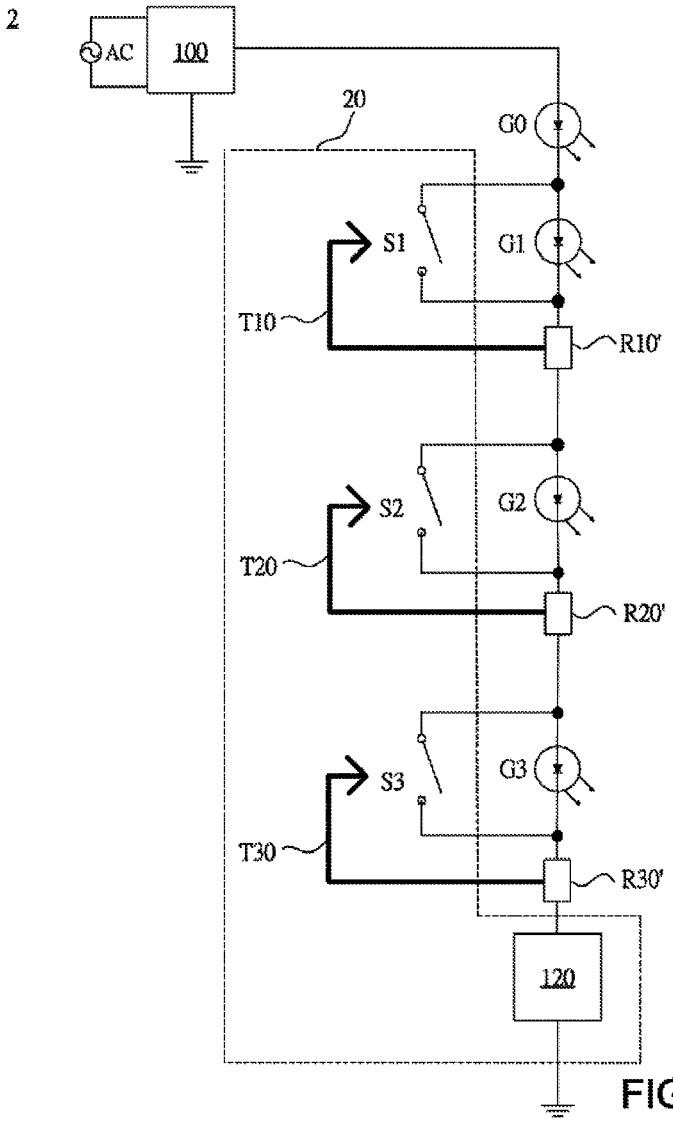
FIG. 1B illustrates a block diagram of an illuminating apparatus 2 equipped with an ac-powered LED light engine 20 designed to gear up from the top down and gear down from the bottom up the interspersed LED sub-arrays G0, G1, G2, and G3 according to an embodiment of the present invention.

FIG. 1B illustrates a block diagram of an illuminating apparatus 2 equipped with an ac-powered LED light engine 20 designed to gear up from the top down and gear down from the bottom up the interspersed LED sub-arrays (G0, G1, G2, and G3) according to an embodiment of the present invention. The illuminating apparatus 2 comprises a rectifier 100 coupled to an AC mains, an ac-powered LED light engine 20, and a plurality of current-sensing resistors (R10', R20', and R30'), and is equipped with a plurality of extrinsic LED sub-arrays (G0, G1, G2, and G3).

The ac-powered LED light engine 20 is coupled between the rectifier 100 and the interspersed LED sub-arrays (G0, G1, G2, and G3), and has a plurality of normally closed bypass switches (S1, S2, and S3) each connected in parallel with a corresponding LED sub-array except for the topmost LED sub-array G0 and shuttling between the three switch states according to a corresponding current sense signal, a plurality of switch controllers (T10, T20, and T30) each coupled between a corresponding current-sensing resistor and a corresponding bypass switch as a feedback network and taking control of the three switch states, and a normally closed current regulator 120 coupled to the ground through its low-side terminal and used to regulate the highest LED current level near the rectified sinusoidal input voltage peak.

The normally closed current regulator 120, the normally closed bypass switches S1, S2, and S3, as well as the switch controllers T10, T20, and T30 in FIG. 1B could be identical to those in FIG. 1A. The switch controllers T10, T20, and T30, assumed for simplification, not for limitation, to have exactly the same reference voltage $V_{REF}$ used for comparison with the current sense signals, respectively rule over the three switch states of the normally closed bypass switches S1, S2, and S3 according to the sensed voltages across the mutually independent current-sensing resistors R10', R20', and R30'. In this embodiment, a downstream current-sensing resistor has a smaller resistance than an upstream one ($R30' < R20' < R10'$), and the unshown current-sensing resistor in the normally closed current regulator 120 has the smallest resistance as compared with the current-sensing resistors R10', R20', and R30'.

Please cross-refer to FIGS. 1B and 2. During the first half of the period, the rectified sinusoidal input voltage goes up to its peak from zero. When the rising input voltage (vi) is still less than the forward voltage drop of the topmost LED sub-array G0 ($0 \leq vi < V_{G0}$), no current flows into the circuit and this interval ($0 \leq t < t_0$) is referred to as the dead time. When the rising input voltage (vi) has been high enough to forward-bias the LED sub-array G0 but is still less than the combined forward voltage drop of the LED sub-arrays G0 and G1 ($V_{G0} \leq vi < V_{G0+G1}$), a constant current I1 lights up the LED sub-array G0 during the interval of ($t_0 \leq t < t_1$).

The constant current I1 would be regulated by the bypass switch S1 through the switch controller T10 according to the design formula $I1 \times R10' = V_{REF}$, i.e.

$$I1 = \frac{V_{REF}}{R10'}.$$

That is to say, the switch controller T10 detects an at-reference current sense signal from the current-sensing resistor R10' ($I1 \times R10' = V_{REF}$), so the bypass switch S1 gets into its REGULATION state to regulate the LED current flowing through the upstream LED sub-array G0 at a constant current level I1 preset with the resistance of R10'

$$\left(I1 = \frac{V_{REF}}{R10'}\right).$$

The switch controllers T20 and T30 each detect a below-reference current sense signal from the current-sensing resistors R20' and R30' respectively ($I1 \times R30' < I1 \times R20' < V_{REF}$), so the normally closed bypass switches S2 and S3 remain in their ON state to short out the LED sub-arrays G2 and G3.

When the rising input voltage (vi) has been high enough to forward-bias the combined LED sub-arrays G0 and G1 but is still less than the combined forward voltage drop of the LED sub-arrays G0, G1, and G2 ($V_{G0+G1} \leq vi < V_{G0+G1+G2}$), a constant current I2 lights up the LED sub-arrays G0 and G1 during the interval of ($t_1 \leq t < t_2$). The switch controller T10 detects an above-reference current sense signal from the current-sensing resistor R10' ($I2 \times R10' > V_{REF}$), so the bypass switch S1 stays in its OFF state to free up the LED sub-array G1. The constant current I2 would be regulated by the bypass switch S2 through the switch controller T20 according to the design formula $I2 \times R20' = V_{REF}$, i.e.

$$I2 = \frac{V_{REF}}{R20'}.$$

That is to say, the switch controller T20 detects an at-reference current sense signal from the current-sensing resistor R20' ($I2 \times R20' = V_{REF}$), so the bypass switch S2 gets into its REGULATION state to regulate the LED current flowing through the upstream LED sub-arrays G0 and G1 at a constant current level I2 preset with the resistance of R20'

$$\left(I2 = \frac{V_{REF}}{R20'}\right).$$

The switch controller T30 detects a below-reference current sense signal from the current-sensing resistor R30' ($I2 \times R30' < V_{REF}$), so the normally closed bypass switch S3 remains in its ON state to short out the LED sub-array G3.

When the rising input voltage (vi) has been high enough to forward-bias the combined LED sub-arrays G0, G1, and G2 but is still less than the combined forward voltage drop of the LED sub-arrays G0, G1, G2, and G3 ($V_{G0+G1+G2} \leq vi < V_{G0+G1+G2+G3}$), a constant current I3 lights up the LED sub-arrays G0, G1, and G2 during the interval of ($t_2 \leq t < t_3$). The constant current I3 would be regulated by the bypass switch S3 through the switch controller T30 according to the design formula $I3 \times R30' = V_{REF}$, i.e.

$$I3 = \frac{V_{REF}}{R30'}.$$

That is to say, the switch controller T30 detects an at-reference current sense signal from the current-sensing resistor R30' ($I3 \times R30' = V_{REF}$), so the bypass switch S3 gets into its REGULATION state to regulate the LED current flowing through the upstream LED sub-arrays G0, G1, and G2 at a constant current level I3 preset with the resistance of R30'

$$\left(I3 = \frac{V_{REF}}{R30'}\right).$$

The switch controllers T10 and T20 each detect an above-reference current sense signal from the current-sensing resistors R10' and R20' respectively ($I3 \times R10' > I3 \times R20' > V_{REF}$), so the bypass switches S1 and S2 stay in their OFF state to free up the LED sub-arrays G1 and G2.

When the input voltage (vi) is high enough to forward-bias all of the LED sub-arrays G0, G1, G2, and G3 ($V_{G0+G1+G2+G3} \leq vi$), a constant current I4 preset with an unshown current-sensing resistor in the normally closed current regulator 120 lights up the LED sub-arrays G0, G1, G2, and G3 in the vicinity of the peak of the rectified sinusoidal input voltage ($t_3 \leq t < t_{3'}$). The aforementioned constant current levels are ranked in the order of I4>I3>I2>I1 for an active bypass switch to deactivate its upstream bypass switches, calling for the sequence of R10'>R20'>R30'. In this way, the ac-powered LED light engine 20 gears up each LED sub-array from the top down.

During the second half of the period, the rectified sinusoidal input voltage goes down to zero from its peak. When the falling input voltage (vi) is still high enough to forward-bias the combined LED sub-arrays G0, G1, and G2 but has been less than the combined forward voltage drop of the LED sub-arrays G0, G1, G2, and G3 ($V_{G0+G1+G2} \leq vi < V_{G0+G1+G2+G3}$), the switch controller T30 detects an at-reference current sense signal from the current-sensing resistor R30' ($I3 \times R30' = V_{REF}$), so the bypass switch S3 gets into its REGULATION state to regulate the LED current flowing through the upstream LED sub-arrays G0, G1, and G2 at the preset constant current level I3 during the interval of ($t_{3'} \leq t < t_{2'}$). The switch controllers T10 and T20 each detect an above-reference current sense signal from the current-sensing resistors R10' and R20' respectively ($I3 \times R10' > I3 \times R20' > V_{REF}$), so the bypass switches S1 and S2 stay in their OFF state to free up the LED sub-arrays G1 and G2.

When the falling input voltage (vi) is still high enough to forward-bias the combined LED sub-arrays G0 and G1 but has been less than the combined forward voltage drop of the LED sub-arrays G0, G1, and G2 ($V_{G0+G1} \leq vi < V_{G0+G1+G2}$), the switch controller T10 detects an above-reference current sense signal from the current-sensing resistor R10' ($I2 \times R10' > V_{REF}$), so the bypass switch S1 stays in its OFF state to free up the LED sub-array G1 during the interval of ($t_{2'} \leq t < t_{1'}$). The switch controller T20 detects an at-reference current sense signal from the current-sensing resistor R20' ($I2 \times R20' = V_{REF}$), so the bypass switch S2 gets into its REGULATION state to regulate the LED current flowing through the upstream LED sub-arrays G0 and G1 at the preset constant current level I2. The switch controller T30 detects a below-reference current sense signal from the current-sensing resistor R30' ($I2 \times R30' < V_{REF}$), so the normally closed bypass switch S3 goes back to its ON state to short out the LED sub-array G3.

When the falling input voltage (vi) is still high enough to forward-bias the LED sub-array G0 but has been less than the combined forward voltage drop of the LED sub-arrays G0 and G1 ($V_{G0} \leq vi < V_{G0+G1}$), the switch controller T10 detects an at-reference current sense signal from the current-sensing resistor R10' ($I1 \times R10' = V_{REF}$), so the bypass switch S1 gets into its REGULATION state to regulate the LED current flowing through the upstream LED sub-array G0 at the preset constant current level I1 during the interval of ($t_{1'} \leq t < t_{0'}$). The switch controllers T20 and T30 each detect a below-reference current sense signal from the current-sensing resistors R20' and R30' respectively ($I1 \times R30' < I1 \times R20' < V_{REF}$), so the normally closed bypass switches S2 and S3 go back to their ON state to short out the LED sub-arrays G2 and G3.

In this way, the ac-powered LED light engine 20 gears down each LED sub-array from the bottom up till all of the LED sub-arrays go out. The number of the aforementioned constant current levels for the ac-powered LED light engine 20, translating to the number of the bypass switches and the switch controllers devised to draw a quasi-sinusoidal line current waveform from the AC sinusoidal line voltage source, could be arbitrarily chosen with a design tradeoff between performance and cost.

Figure 1C:
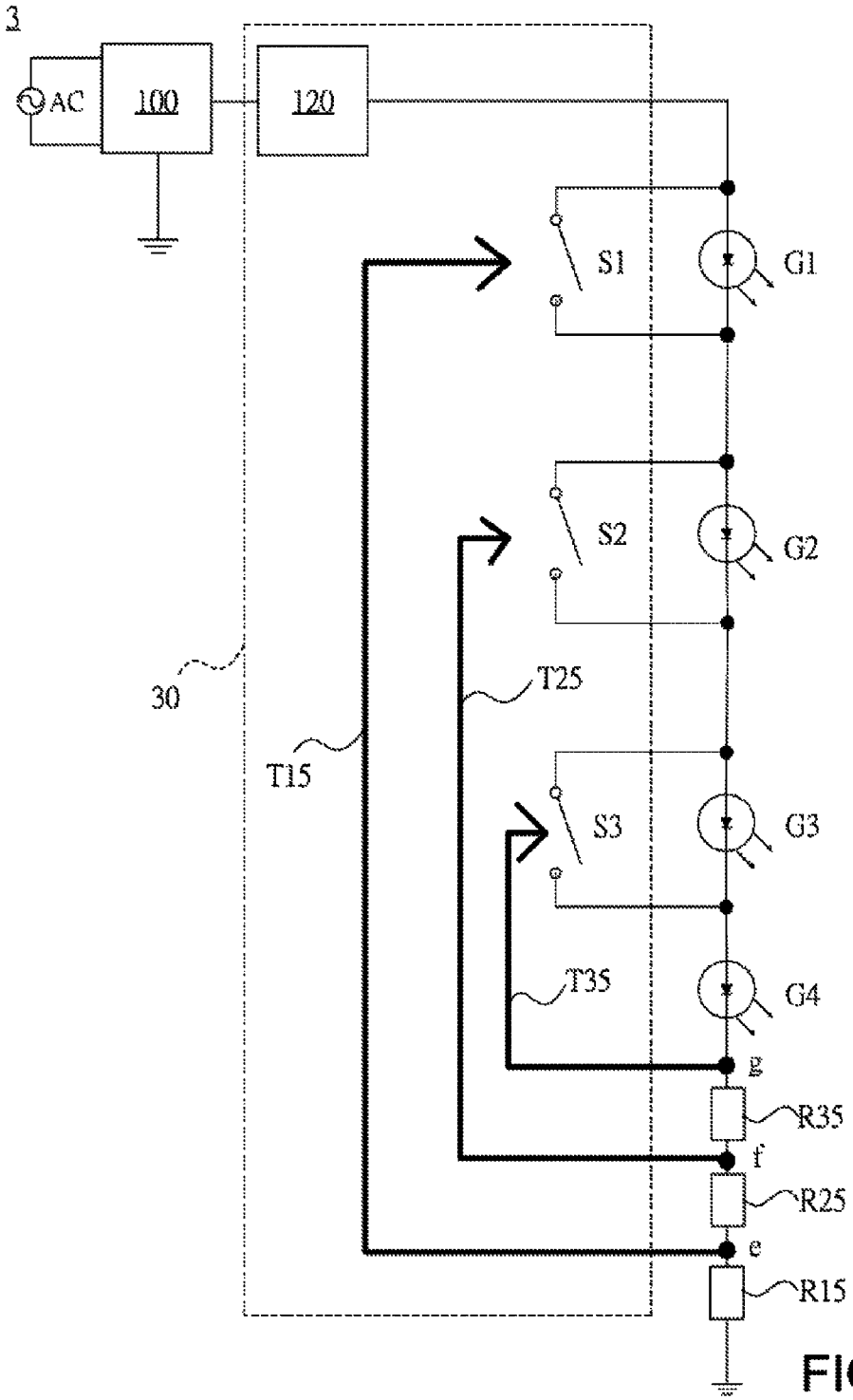
FIG. 1C illustrates a block diagram of an illuminating apparatus 3 equipped with an ac-powered LED light engine 30 designed to gear up from the bottom up and gear down from the top down a string of LED sub-arrays G1, G2, G3, and G4 according to another embodiment of the present invention.

FIG. 1C illustrates a block diagram of an illuminating apparatus 3 equipped with an ac-powered LED light engine 30 designed to gear up from the bottom up and gear down from the top down a string of LED sub-arrays (G1, G2, G3, and G4) according to an embodiment of the present invention. The illuminating apparatus 3 comprises a rectifier 100 coupled to an AC mains, an ac-powered LED light engine 30, and a string of current-sensing resistors (R15, R25, and R35) respectively tapped off of their high-side nodes e, f, and g for providing current sense signals, and is equipped with a string of extrinsic LED sub-arrays (G1, G2, G3, and G4).

The ac-powered LED light engine 30 is coupled between the rectifier 100 and the LED sub-arrays (G1, G2, G3, and G4), and has a normally closed current regulator 120 coupled to the rectifier 100 through its high-side terminal and used to regulate the highest LED current level near the rectified sinusoidal input voltage peak, a plurality of normally closed bypass switches (S1, S2, and S3) each connected in parallel with a corresponding LED sub-array except for the bottommost LED sub-array G4 and shuttling between the three switch states according to a corresponding current-sense signal, and a plurality of switch controllers (T15, T25, and T35) each coupled between a corresponding current sense tap and a corresponding bypass switch as a feedback network and taking control of the three switch states.

The switch controllers T15, T25, and T35, assumed for simplification, not for limitation, to have exactly the same reference voltage $V_{REF}$ used for comparison with the current sense signals, respectively rule over the three switch states of the normally closed bypass switches S1, S2, and S3 according to the sensed voltages at the sense taps e, f, and g, i.e. across the mutually dependent current-sensing resistors R15, R15+R25, and R15+R25+R35.

Please cross-refer to FIGS. 1C and 2. During the first half of the period, the rectified sinusoidal input voltage goes up to its peak from zero. When the rising input voltage (vi) is still less than the forward voltage drop of the bottommost LED sub-array G4 ($0 \le vi < V_{G4}$), no current flows into the circuit and this interval ($0 \le t < t_0$) is also known as the dead time. When the rising input voltage (vi) has been high enough to forward-bias the LED sub-array G4 but is still less than the combined forward voltage drop of the LED sub-arrays G3 and G4 ($V_{G4} \le vi < V_{G3+G4}$), a constant current I1 lights up the LED sub-array G4 during the interval of ($t_0 \le t < t_1$). The constant current I1 would be regulated by the bypass switch S3 through the switch controller T35 according to the design formula $I1 \times (R15+R25+R35) = V_{REF}$, i.e.

$$I1 = \frac{V_{REF}}{R15 + R25 + R35}.$$

That is to say, the switch controller T35 detects an at-reference current sense signal from the sense tap g ($I1 \times (R15+R25+R35) = V_{REF}$), so the bypass switch S3 gets into its REGULATION state to regulate the LED current flowing through the downstream LED sub-array G4 at a constant current level I1 preset with the combined resistance of R15, R25 and R35

$$\left(I1 = \frac{V_{REF}}{R15 + R25 + R35}\right).$$

The switch controllers T15 and T25 each detect a below-reference current sense signal from the sense taps e and f respectively ($I1 \times R15 < I1 \times (R15+R25) < V_{REF}$), so the normally closed bypass switches S1 and S2 remain in their ON state to short out the LED sub-arrays G1 and G2.

When the rising input voltage (vi) has been high enough to forward-bias the combined LED sub-arrays G3 and G4 but is still less than the combined forward voltage drop of the LED sub-arrays G2, G3, and G4 ($V_{G3+G4} \le vi < V_{G2+G3+G4}$), a constant current I2 lights up the LED sub-arrays G3 and G4 during the interval of ($t_1 \le t < t_2$). The switch controller T35 detects an above-reference current sense signal from the sense tap g ($I2 \times (R15+R25+R35) > V_{REF}$), so the bypass switch S3 stays in its OFF state to free up the LED sub-array G3. The constant current I2 would be regulated by the bypass switch S2 through the switch controller T25 according to the design formula $I2 \times (R15+R25) = V_{REF}$, i.e.

$$I2 = \frac{V_{REF}}{R15 + R25}.$$

That is to say, the switch controller T25 detects an at-reference current sense signal from the sense tap f ($I2 \times (R15+R25) = V_{REF}$), so the bypass switch S2 gets into its REGULATION state to regulate the LED current flowing through the downstream LED sub-arrays G3 and G4 at a constant current level I2 preset with the combined resistance of R15 and R25

$$\left(I2 = \frac{V_{REF}}{R15 + R25}\right).$$

The switch controller T15 detects a below-reference current sense signal from the sense tap e ($I2 \times R15 < V_{REF}$), so the normally closed bypass switch S1 remains in its ON state to short out the LED sub-array G1.

When the rising input voltage (vi) has been high enough to forward-bias the combined LED sub-arrays G2, G3, and G4 but is still less than the combined forward voltage drop of the LED sub-arrays G1, G2, G3, and G4 ($V_{G2+G3+G4} \le vi < V_{G1+G2+G3+G4}$), a constant current I3 lights up the LED sub-arrays G2, G3, and G4 during the interval of ($t_2 \le t < t_3$). The constant current I3 would be regulated by the bypass switch S1 through the switch controller T15 according to the design formula $I3 \times R15 = V_{REF}$, i.e.

$$I3 = \frac{V_{REF}}{R15}.$$

That is to say, the switch controller T15 detects an at-reference current sense signal from the sense tap e ($I3 \times R15 = V_{REF}$), so the bypass switch S1 gets into its REGULATION state to regulate the LED current flowing through the downstream LED sub-arrays G2, G3, and G4 at a constant current level I3 preset with the resistance of R15

$$\left(I3 = \frac{V_{REF}}{R15}\right).$$

The switch controllers T25 and T35 each detect an above-reference current sense signal from the sense taps f and g respectively ($I3 \times (R15+R25+R35) > I3 \times (R15+R25) > V_{REF}$), so the bypass switches S2 and S3 stay in their OFF state to free up the LED sub-arrays G2 and G3.

When the input voltage (vi) is high enough to forward-bias all of the LED sub-arrays G1, G2, G3, and G4 ($V_{G1+G2+G3+G4} \le vi$), a constant current I4 preset with an unshown current-sensing resistor in the normally closed current regulator 120 lights up the LED sub-arrays G1, G2, G3, and G4 in the vicinity of the peak of the rectified sinusoidal input voltage ($t_3 \leq t < t_{3'}$). The aforementioned constant current levels are ranked in the order of I4>I3>I2>I1 for an active bypass switch to deactivate its downstream bypass switches. In this way, the ac-powered LED light engine 30 gears up each LED sub-array from the bottom up.

During the second half of the period, the rectified sinusoidal input voltage goes down to zero from its peak. When the falling input voltage (vi) is still high enough to forward-bias the combined LED sub-arrays G2, G3, and G4 but has been less than the combined forward voltage drop of the LED sub-arrays G1, G2, G3, and G4 ($V_{G2+G3+G4} \leq vi < V_{G1+G2+G3+G4}$), the switch controller T15 detects an at-reference current sense signal from the sense tap e (I3×R15=$V_{REF}$), so the bypass switch S1 gets into its REGULATION state to regulate the LED current flowing through the downstream LED sub-arrays G2, G3, and G4 at the preset constant current level I3 during the interval of ($t_{3'} \leq t < t_{2'}$). The switch controllers T25 and T35 each detect an above-reference current sense signal from the sense taps f and g respectively (($I3 \times (R15+R25+R35) > I3 \times (R15+R25) > V_{REF}$)), so the bypass switches S2 and S3 stay in their OFF state to free up the LED sub-arrays G2 and G3.

When the falling input voltage (vi) is still high enough to forward-bias the combined LED sub-arrays G3 and G4 but has been less than the combined forward voltage drop of the LED sub-arrays G2, G3, and G4 ($V_{G3+G4} \leq vi < V_{G2+G3+G4}$), the switch controller T35 detects an above-reference current sense signal from the sense tap g ($I2 \times (R15+R25+R35) > V_{REF}$), so the bypass switch S3 stays in its OFF state to free up the LED sub-array G3 during the interval of ($t_{2'} \leq t < t_{1'}$). The switch controller T25 detects an at-reference current sense signal from the sense tap f ($I2 \times (R15+R25) = V_{REF}$), so the bypass switch S2 gets into its REGULATION state to regulate the LED current flowing through the downstream LED sub-arrays G3 and G4 at the preset constant current level I2. The switch controller T15 detects a below-reference current sense signal from the sense tap e ($I2 \times R15 < V_{REF}$), so the normally closed bypass switch S1 goes back to its ON state to short out the LED sub-array G1.

When the falling input voltage (vi) is still high enough to forward-bias the LED sub-array G4 but has been less than the combined forward voltage drop of the LED sub-arrays G3 and G4 ($V_{G4} \leq vi < V_{G3+G4}$), the switch controller T35 detects an at-reference current sense signal from the sense tap g ($I1 \times (R15+R25+R35) = V_{REF}$), so the bypass switch S3 gets into its REGULATION state to regulate the LED current flowing through the downstream LED sub-array G4 at the preset constant current level I1 during the interval of ($t_{1'} \leq t < t_{0'}$). The switch controllers T15 and T25 each detect a below-reference current sense signal from the sense taps e and f respectively ($I1 \times R15 < I1 \times (R15+R25) < V_{REF}$), so the normally closed bypass switches S1 and S2 go back to their ON state to short out the LED sub-arrays G1 and G2.

In this way, the ac-powered LED light engine 30 gears down each LED sub-array from the top down till all of the LED sub-arrays go out. The number of the aforementioned constant current levels for the ac-powered LED light engine 30, translating to the number of the bypass switches and the switch controllers devised to draw a quasi-sinusoidal line current waveform from the AC sinusoidal line voltage source, could be arbitrarily chosen with a design tradeoff between performance and cost.

By analogy with the symmetry between FIG. 1B and FIG. 1A, it is possible to construct a counterpart of FIG. 1C so as to gear up from the top down and gear down from the bottom up the LED sub-arrays by recasting the bottommost LED sub-array G4 as the topmost one and shuffling the corresponding relationship between the switch controllers and the bypass switches, i.e. (T35, S3), (T25, S2), and (T15, S1) are regrouped as (T35, S1), (T25, S2), and (T15, S3).

Figure 1D:
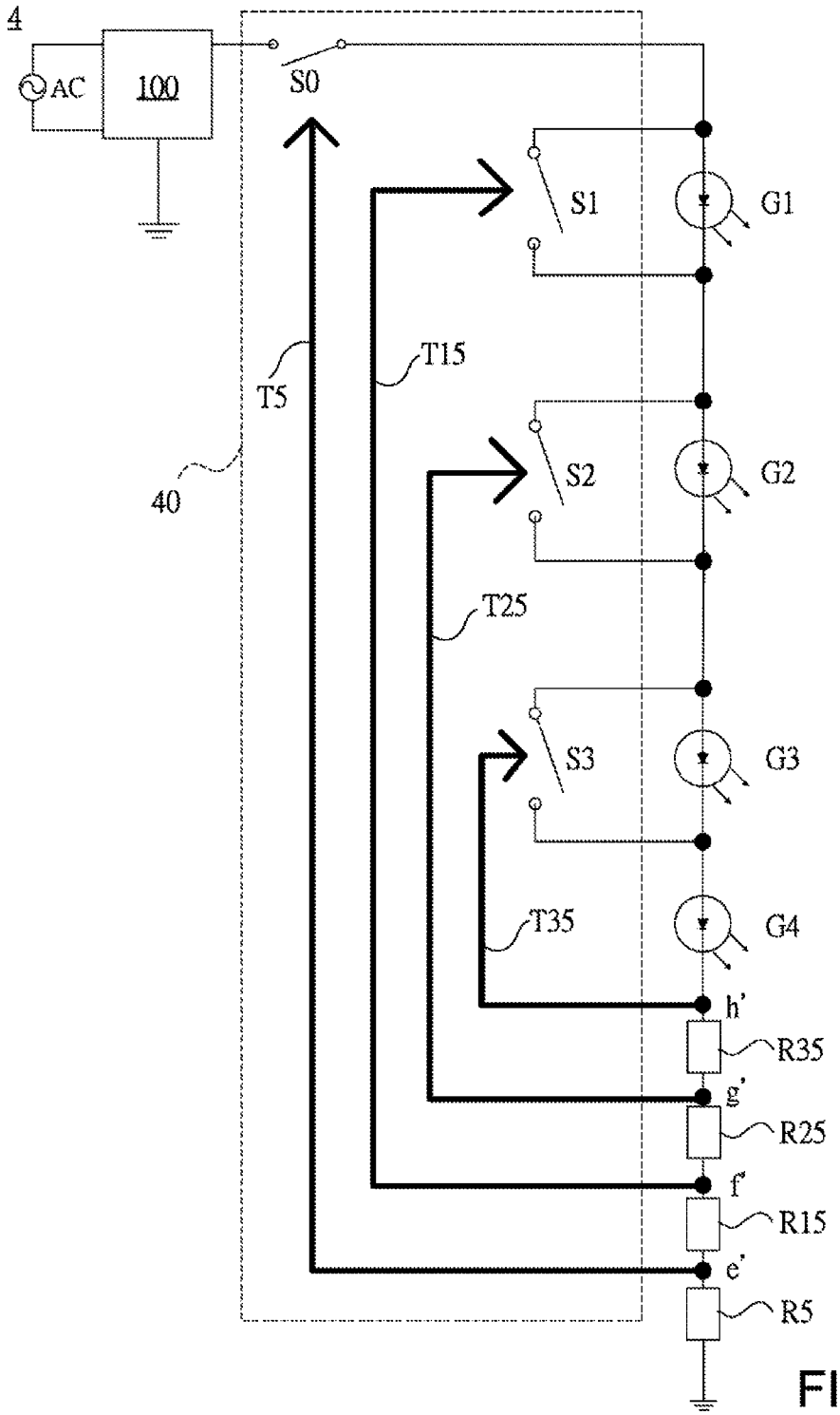
FIG. 1D illustrates a block diagram of an illuminating apparatus 4 equipped with an ac-powered LED light engine 40 designed to gear up from the bottom up and gear down from the top down a string of LED sub-arrays G1, G2, G3, and G4 according to still another embodiment of the present invention.

FIG. 1D illustrates a block diagram of an illuminating apparatus 4 equipped with an ac-powered LED light engine 40 designed to gear up from the bottom up and gear down from the top down a string of LED sub-arrays (G1, G2, G3, and G4) according to an embodiment of the present invention. The illuminating apparatus 4 comprises a rectifier 100 coupled to an AC mains, an ac-powered LED light engine 40, and a string of current-sensing resistors (R5, R15, R25, and R35) respectively tapped off of their high-side nodes e', f', g', and h' for providing current sense signals, and is equipped with a string of extrinsic LED sub-arrays (G1, G2, G3, and G4).

The ac-powered LED light engine 40 is coupled between the rectifier 100 and the LED sub-arrays (G1, G2, G3, and G4), and has a normally closed current-regulating switch S0 coupled to the rectifier 100 through its high-side terminal, controlled by a switch controller T5 according to a corresponding current sense signal, and used to regulate the highest LED current level near the rectified sinusoidal input voltage peak, a plurality of normally closed bypass switches (S1, S2, and S3) each connected in parallel with a corresponding LED sub-array except for the bottommost LED sub-array G4 and shuttling between the three switch states according to a corresponding current sense signal, and a plurality of switch controllers (T15, T25, and T35) each coupled between a corresponding current sense tap and a corresponding bypass switch as a feedback network and taking control of the three switch states. The normally closed current-regulating switch S0 controlled by a switch controller T5 can be used to replace the current regulator in other embodiments.

The switch controllers T5, T15, T25, and T35, assumed for simplification, not for limitation, to have exactly the same reference voltage $V_{REF}$ used for comparison with the current sense signals, respectively rule over the three switch states of the normally closed current-regulating switch S0 as well as the normally closed bypass switches S1, S2, and S3 according to the sensed voltages at the sense taps e', f', g', and h', i.e. across the mutually dependent current-sensing resistors R5, R5+R15, R5+R15+R25, and R5+R15+R25+R35.

Similar to the working principle of the ac-powered LED light engine 30 in FIG. 1C, contrastively using an uncontrolled current regulator 120 to regulate the highest LED current level, the working principle of the ac-powered LED light engine 40 in FIG. 1D, contrastively using a controlled current-regulating switch S0 to regulate the highest LED current level, is evidently self-explanatory without any need for further elaboration, which would otherwise become redundant. It is also possible to construct a counterpart of FIG. 1D so as to gear up from the top down and gear down from the bottom up the LED sub-arrays by recasting the bottommost LED sub-array G4 as the topmost one and shuffling the corresponding relationship between the switch controllers and the bypass switches, i.e. (T35, S3), (T25, S2), and (T15, S1) are regrouped as (T35, S1), (T25, S2), and (T15, S3).

Figure 3A:
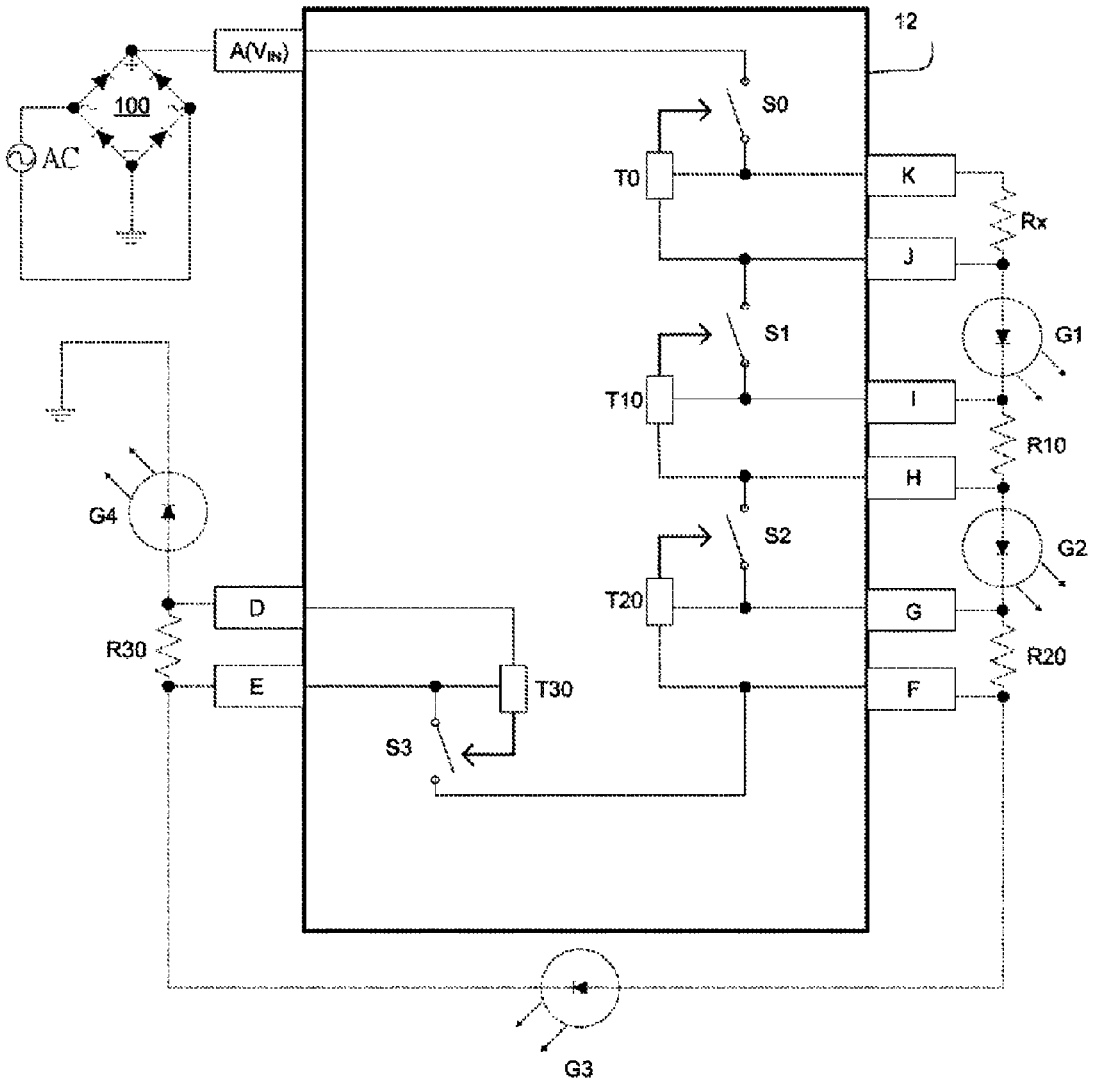
FIG. 3A illustrates a schematic diagram of an integrated circuit having the ac-powered LED light engine according to an embodiment of the present invention.
Figure 3B:
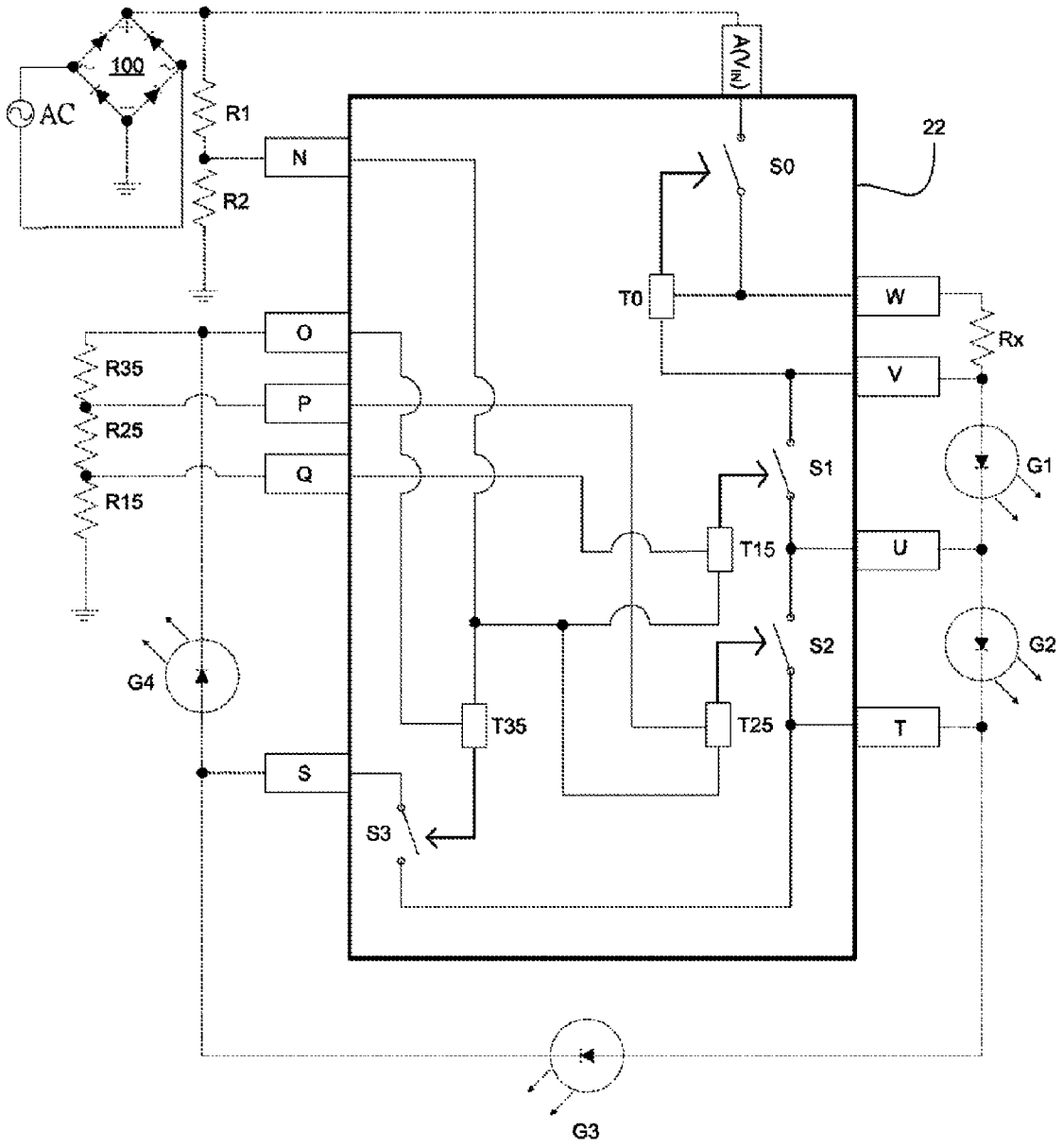
FIG. 3B illustrates a schematic diagram of an integrated circuit having the ac-powered LED light engine according to another embodiment of the present invention.

FIGS. 3A and 3B respectively illustrate the integrated circuits having the ac-powered LED light engines shown in FIGS. 1A and 1C according to different embodiments of the present invention. With respect to FIG. 3A, the integrated circuit 12 has nine pins A, D, E, F, G, H, I, J, and K, four interspersed bypass switches S0, S1, S2, and S3, as well as four switch controllers T0, T10, T20, and T30. In this embodiment, the current-sensing resistors Rx, R10, R20, and R30 are placed outside the integrated circuit 12 to make the constant current levels programmable to circuit designers. In other embodiments, the fixed current-sensing resistors Rx, R10, R20, and R30 can also be built inside the integrated circuit 12 to further reduce the parts count of the overall circuit.

The integrated circuit 12 has its pin A coupled between the rectifier 100 and the high-side terminal of the current-regulating switch S0, its pin D coupled between the low-side terminal of the current-sensing resistor R30 (the anode of the LED sub-array G4) and the low-side terminal of the switch controller T30, its pin E coupled between the high-side terminal of the current-sensing resistor R30 (the cathode of the LED sub-array G3) and the low-side terminal of the bypass switch S3 (the reference terminal of the switch controller T30), its pin F coupled between the low-side terminal of the current-sensing resistor R20 (the anode of the LED sub-array G3) and the high-side terminal of the bypass switch S3 (the low-side terminal of the switch controller T20), its pin G coupled between the high-side terminal of the current-sensing resistor R20 (the cathode of the LED sub-array G2) and the low-side terminal of the bypass switch S2 (the reference terminal of the switch controller T20), its pin H coupled between the low-side terminal of the current-sensing resistor R10 (the anode of the LED sub-array G2) and the high-side terminal of the bypass switch S2 (the low-side terminal of the switch controller T10), its pin I coupled between the high-side terminal of the current-sensing resistor R10 (the cathode of the LED sub-array G1) and the low-side terminal of the bypass switch S1 (the reference terminal of the switch controller T10), its pin J coupled between the low-side terminal of the current-sensing resistor Rx (the anode of the LED sub-array G1) and the high-side terminal of the bypass switch S1 (the low-side terminal of the switch controller T0), and its pin K coupled between the high-side terminal of the current-sensing resistor Rx and the low-side terminal of the current-regulating switch S0 (the reference terminal of the switch controller T0).

With respect to FIG. 3B, the integrated circuit 22 has ten pins A, N, O, P, Q, S, T, U, V, and W, four bypass switches S0, S1, S2, and S3, as well as four switch controllers T0, T15, T25, and T35. In this embodiment, the current-sensing resistors Rx, R35, R25, and R15 are placed outside the integrated circuit 22 to make the constant current levels programmable to circuit designers. In other embodiments, the fixed current-sensing resistors Rx, R35, R25, and R15 can also be built inside the integrated circuit 22 to further reduce the parts count of the overall circuit.

The integrated circuit 22 has its pin A coupled between the rectifier 100 and the high-side terminal of the current-regulating switch S0, its pin N coupled between the low-side terminal of the voltage-dividing resistor R1 (the high-side terminal of the voltage-dividing resistor R2) and the low-side terminals of the switch controllers T15, T25, and T35, its pin O coupled between the high-side terminal of the current-sensing resistor R35 (the cathode of the LED sub-array G4) and the reference terminal of the switch controller T35, its pin P coupled between the low-side terminal of the current-sensing resistor R35 (the high-side terminal of the current-sensing resistor R25) and the reference terminal of the current regulator T25, its pin Q coupled between the low-side terminal of the current-sensing resistor R25 (the high-side terminal of the current-sensing resistor R15) and the reference terminal of the switch controller T15, its pin S coupled between the anode of the LED sub-array G4 (the cathode of the LED sub-array G3) and the low-side terminal of the bypass switch S3, its pin T coupled between the anode of the LED sub-array G3 (the cathode of the LED sub-array G2) and the low-side terminal of the bypass switch S2 (the high-side terminal of the bypass switch S3), its pin U coupled between the anode of the LED sub-array G2 (the cathode of the LED sub-array G1) and the high-side terminal of the bypass switch S2 (the low-side terminal of the bypass switch S1), its pin V coupled between the low-side terminal of the current-sensing resistor Rx (the anode of the LED sub-array G1) and the high-side terminal of the bypass switch S1 (the low-side terminal of the switch controller T0), and its pin W coupled between the high-side terminal of the current-sensing resistor Rx and the low-side terminal of the current-regulating switch S0 (the reference terminal of the switch controller T0).

Figure 4:
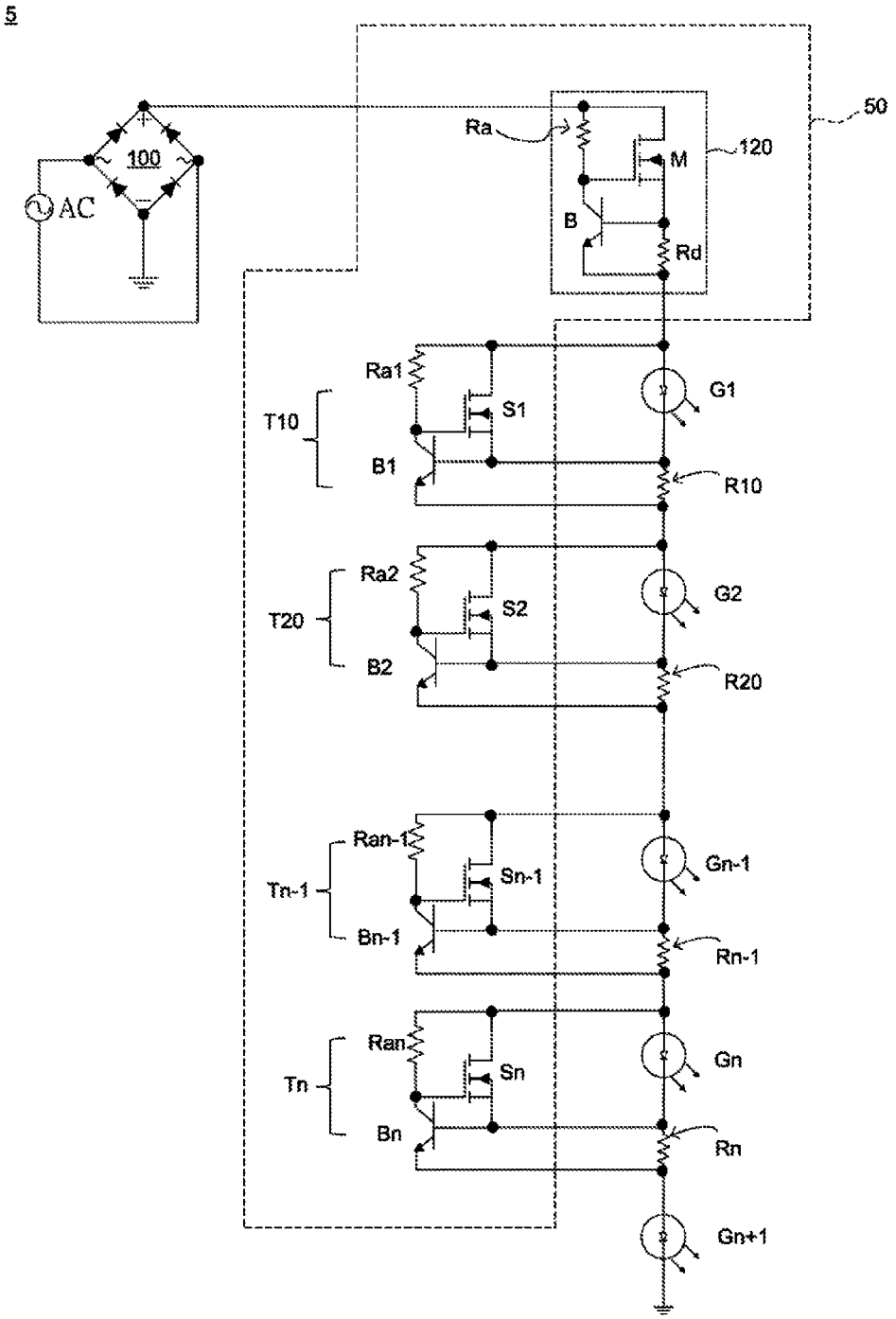
FIG. 4 illustrates a schematic diagram of an illuminating apparatus equipped with the ac-powered LED light engine shown in FIG. 1A.

FIG. 4 illustrates a schematic diagram of an illuminating apparatus 5 equipped with the ac-powered LED light engine 50 shown in FIG. 1A. The illuminating apparatus 5 comprises a rectifier 100 coupled to an AC mains, an ac-powered LED light engine 50, a plurality of interspersed LED sub-arrays (G1, G2, . . . , Gn−1, and Gn), and a plurality of interspersed current-sensing resistors (R10, R20, . . . , Rn−1, and Rn). A downstream current-sensing resistor has a larger resistance than an upstream one (Rn>Rn−1> . . . >R20>R10), and the current-sensing resistor Rd in the normally closed current regulator 120 has the smallest resistance as compared with the current-sensing resistors Rn, Rn−1, . . . , R20, and R10. The ac-powered LED light engine 50 comprises a normally closed current regulator 120, a plurality of normally closed bypass switches (S1, S2, . . . , Sn−1, and Sn) each connected in parallel with a corresponding LED sub-array except for the bottommost LED sub-array Gn+1 and shuttling between the three switch states according to a corresponding current sense signal, and a plurality of switch controllers T10, T20, . . . , Tn−1, and Tn each coupled between a corresponding current-sensing resistor and a corresponding bypass switch as a feedback network and taking control of the three switch states. Each of the normally closed bypass switches S1, S2, . . . , Sn−1, and Sn is an enhancement-mode n-channel MOSFET in collocation with an adequate switch controller. Each of the switch controllers T10, T20, . . . , Tn−1, and Tn is a BJT-based gate-driving circuit, comprising a gate-charging resistor (Ra1, Ra2, . . . , Ran−1, and Ran) for turning on a corresponding bypass switch (S1, S2, . . . , Sn−1, and Sn) and a voltage-comparing BJT (B1, B2, . . . , Bn−1, and Bn) for turning off a corresponding bypass switch (S1, S2, . . . , Sn−1, and Sn), in control of the three switch states.

In this embodiment, the normally closed current regulator 120 comprises a current-regulating switch M (an enhancement-mode n-channel MOSFET), a gate-charging resistor Ra, a voltage-comparing BJT B, and a current-sensing resistor Rd. The current-regulating switch M has its drain coupled to the rectifier 100 (the high-side terminal of the gate-charging resistor Ra), its gate coupled to the low-side terminal of the gate-charging resistor Ra (the collector of the voltage-comparing BJT B), and its source coupled to the high-side terminal of the current-sensing resistor Rd (the base of the voltage-comparing BJT B).

This paragraph briefly gives the reason why an enhancement-mode n-channel MOSFET could turn into a normally closed switch. In the initial state, all of the intrinsic gate-source capacitors inside the current-regulating switch M as well as the bypass switches S1, S2, . . . , Sn−1, and Sn could simultaneously get charged up to above their threshold voltage level through a corresponding gate-charging resistor so as to make their channels normally closed once the rectified sinusoidal input voltage has been high enough to forward-bias the bottommost LED sub-array Gn+1 after the random power-on of the lighting apparatus 5.

Based on the comparison between an applied gate-source voltage $V_{GS}$ and a positive threshold voltage $V_{th}$, an enhancement-mode n-channel MOSFET would operate in its ON state ($V_{GS}>V_{th}$) due to charging of its intrinsic gate-source capacitor through a corresponding gate-charging resistor when a corresponding below-reference current sense signal turns a corresponding voltage-comparing BJT off, in its REGULATION state ($V_{GS}=V_{th}$) due to charging and discharging of its intrinsic gate-source capacitor through a corresponding gate-charging resistor and a corresponding voltage-comparing BJT when a corresponding at-reference current sense signal turns a corresponding voltage-comparing BJT off and on, or in its OFF state ($V_{GS}<V_{th}$) due to discharging of its intrinsic gate-source capacitor through a corresponding voltage-comparing BJT when a corresponding above-reference current sense signal turns a corresponding voltage-comparing BJT on. As such, all of the normally closed bypass switches S1, S2, . . . , Sn−1, and Sn would shuttle between the three switch states except for the normally closed current-regulating switch M excluding its OFF state from the three switch states.

Figure 5:
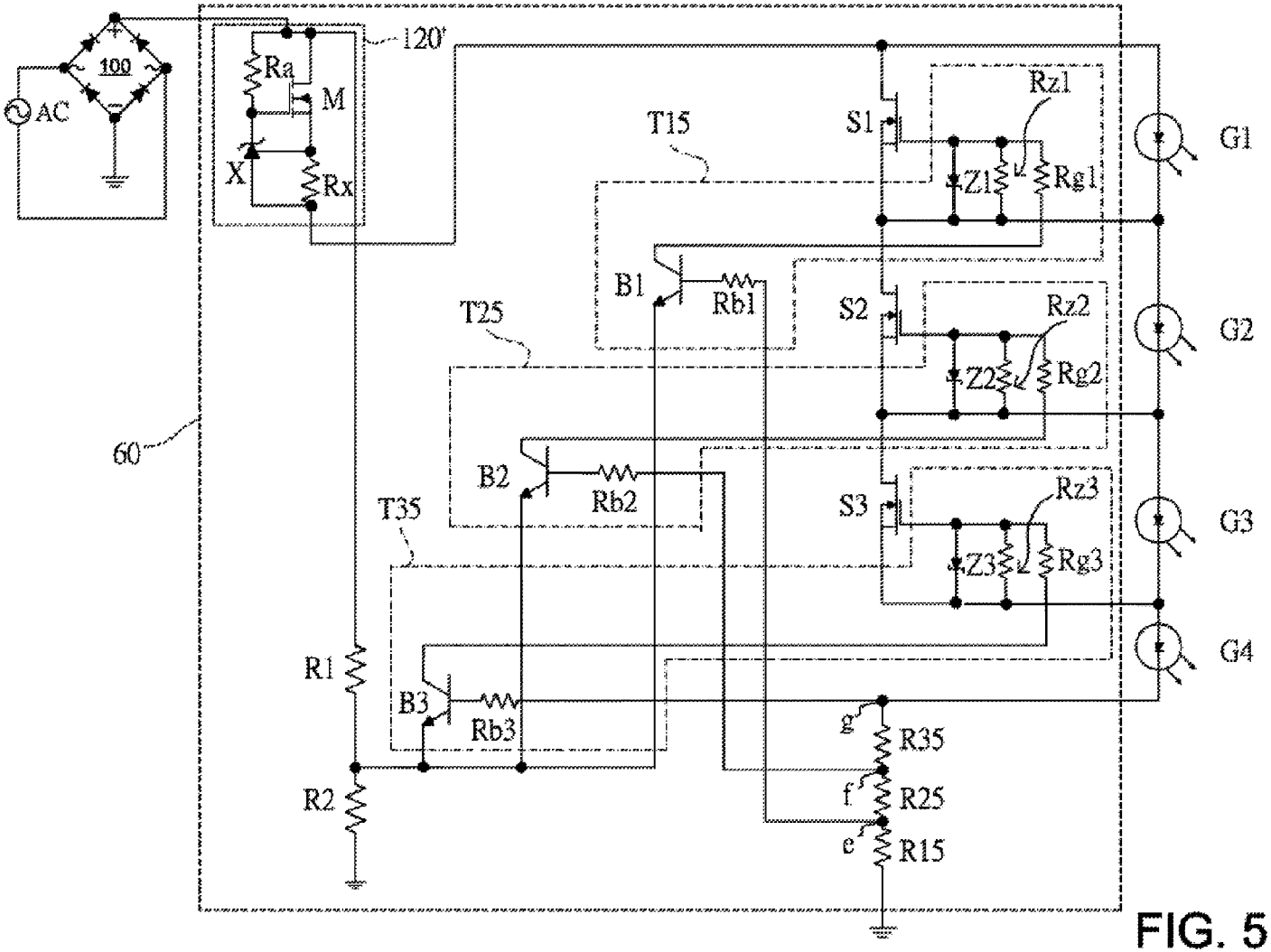
FIG. 5 illustrates a schematic diagram of an illuminating apparatus equipped with the ac-powered LED light engine shown in FIG. 1C.

FIG. 5 illustrates a schematic diagram of an illuminating apparatus 6 equipped with the ac-powered LED light engine 60 shown in FIG. 1C. The illuminating apparatus 6 comprises a rectifier 100 coupled to an AC mains, an ac-powered LED light engine 60, a string of LED sub-arrays (G1, G2, G3, and G4), and a string of current-sensing resistors (R15, R25, and R35) respectively tapped off of their high-side nodes e, f, and g for providing current sense signals. The ac-powered LED light engine 60 comprises a normally closed current regulator 120', a string of normally closed bypass switches (S1, S2, and S3) each connected in parallel with a corresponding LED sub-array except for the bottommost LED sub-array G4 and shuttling between the three switch states according to a corresponding current sense signal, and a plurality of switch controllers each coupled between a corresponding current sense tap and a corresponding bypass switch as a feedback network and taking control of the three switch states. Each of the normally closed bypass switches S1, S2, and S3 is a depletion-mode n-channel MOSFET in collocation with an adequate switch controller. Each of the switch controllers, shown as T15, T25, and T35 in FIG. 1C, is a BJT-based gate-driving circuit, comprising a gate-discharging resistor (Rz1, Rz2, and Rz3) for turning on a corresponding bypass switch (S1, S2, and S3) as well as a voltage-comparing BJT (B1, B2, and B3), an anti-clamping resistor (Rb1, Rb2, and Rb3), a voltage-dividing resistor (Rg1, Rg2, and Rg3), and a voltage-clamping Zener diode (Z1, Z2, and Z3) for turning off a corresponding bypass switch (S1, S2, and S3), in control of the three switch states. A voltage divider, comprising resistors R1 and R2 in series, adds a scaled-down sample of the rectified sinusoidal input voltage $$\left(\frac{v_i \times R2}{R1 + R2}\right)$$

to the emitters of the voltage-comparing BJTs B1, B2, and B3 so that current sense signals would be compared with a sinusoidal-modulated reference voltage $$V_{REF} + \frac{v_i \times R2}{R1 + R2}$$

rather than a fixed reference voltage $V_{REF}$ to further smooth a stepping current waveform into a more sinusoidal one for getting an even higher PF and an even lower THD.

In this embodiment, the normally closed current regulator 120' comprises a current-regulating switch M (an enhancement-mode n-channel MOSFET), a gate-charging resistor Ra, a shunt regulator X, and a current-sensing resistor Rx. The current-regulating switch M has its drain coupled to the rectifier 100 (the high-side terminal of the gate-charging resistor Ra), its gate coupled to the low-side terminal of the gate-charging resistor Ra (the cathode of the shunt regulator X), and its source coupled to the high-side terminal of the current-sensing resistor Rx (the reference terminal of the shunt regulator X).

It is crystal clear a depletion-mode n-channel MOSFET is essentially a normally closed switch. Only the current-regulating switch M needs to get initialized as a normally closed switch after the random power-on of the illuminating apparatus 6. Understandable from that of FIG. 4, the initialization process of FIG. 5 is not repeated herein. Based on the comparison between an applied gate-source voltage $V_{GS}$ and a negative threshold voltage $V_{th}$, a depletion-mode n-channel MOSFET would operate in its ON state ($V_{GS}>V_{th}$) due to discharging of its intrinsic gate-source capacitor through a corresponding gate-discharging resistor when a corresponding below-reference current sense signal turns a corresponding voltage-comparing BJT off, in its REGULATION state ($V_{GS}=V_{th}$) due to discharging and charging of its intrinsic gate-source capacitor through a corresponding gate-discharging resistor as well as a corresponding voltage-comparing BJT, a corresponding anti-clamping resistor, a corresponding voltage-dividing resistor, and a corresponding voltage-clamping Zener diode when a corresponding at-reference current sense signal turns a corresponding voltage-comparing BJT off and on, or in its OFF state ($V_{GS}<V_{th}$) due to charging of its intrinsic gate-source capacitor through a corresponding voltage-comparing BJT, a corresponding anti-clamping resistor, a corresponding voltage-dividing resistor, and a corresponding voltage-clamping Zener diode when a corresponding above-reference current sense signal turns a corresponding voltage-comparing BJT on. As such, all of the normally closed bypass switches S1, S2, and S3 would shuttle between the three switch states except for the normally closed current-regulating switch M excluding its OFF state from the three switch states.

Figure 6:
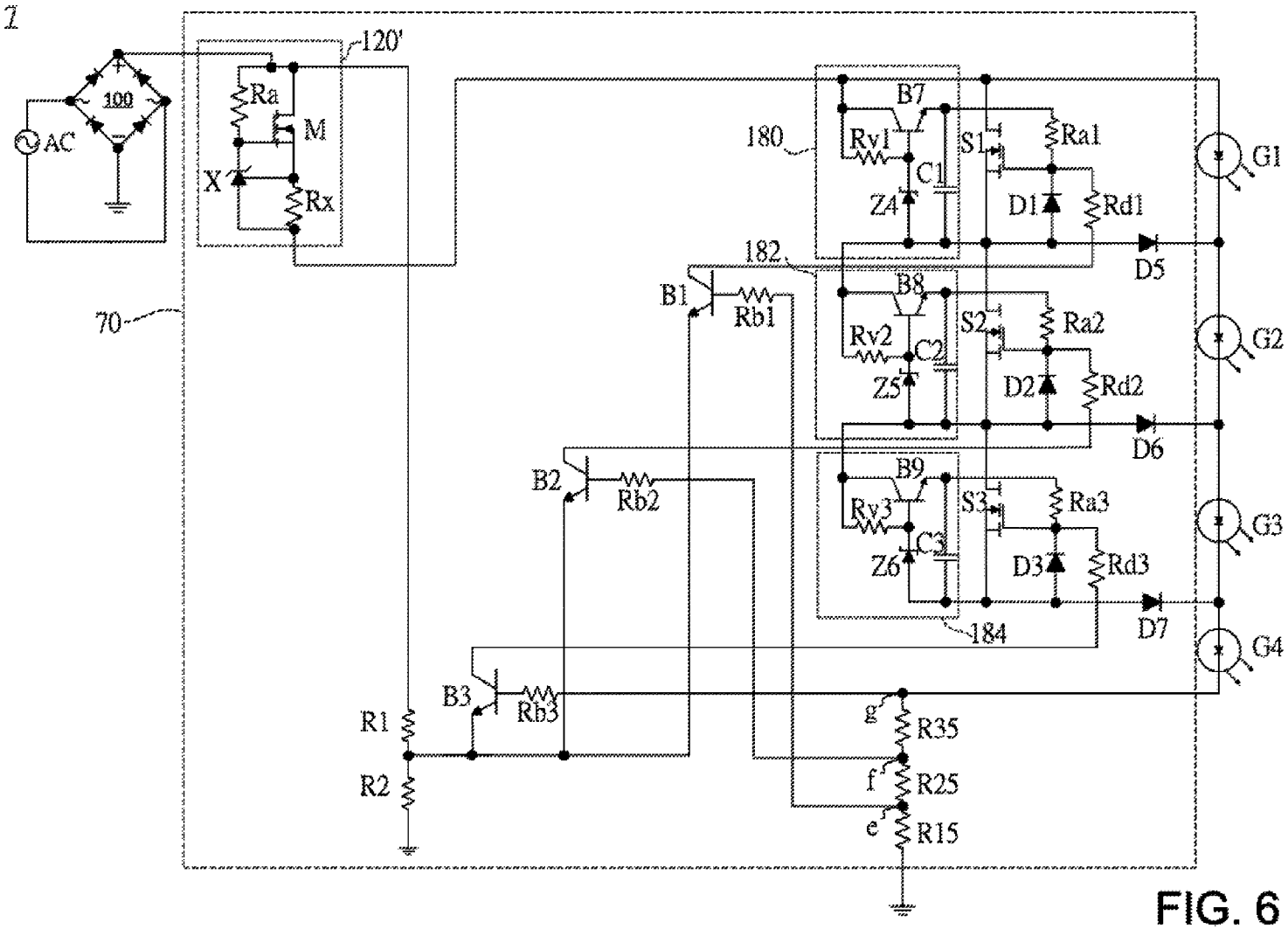
FIG. 6 illustrates another schematic diagram of an illuminating apparatus equipped with the ac-powered LED light engine shown in FIG. 1C.

FIG. 6 illustrates a schematic diagram of an illuminating apparatus 7 equipped with the ac-powered LED light engine 70 shown in FIG. 1C. The illuminating apparatus 7 comprises a rectifier 100 coupled to an AC mains, an ac-powered LED light engine 70, a string of LED sub-arrays (G1, G2, G3, and G4), and a string of current-sensing resistors (R15, R25, and R35) respectively tapped off of their high-side nodes e, f, and g for providing current sense signals. The ac-powered LED light engine 70 comprises a normally closed current regulator 120', a string of normally closed bypass switches (S1, S2, and S3) each connected in parallel with a corresponding LED sub-array except for the bottommost LED sub-array G4 and shuttling between the three switch states according to a corresponding current sense signal, and a plurality of switch controllers each coupled between a corresponding current sense tap and a corresponding bypass switch as a feedback network and taking control of the three switch states.

The structure of the normally closed current regulator 120' in FIG. 6 is exactly the same as that in FIG. 5, and therefore is not repeated herein. Each of the bypass switches S1, S2, and S3 is an enhancement-mode n-channel MOSFET, turning into a normally closed switch after the initialization process, in collocation with an adequate switch controller. Each of the switch controllers, shown as T15, T25, and T35 in FIG. 1C, is a BJT-based gate-driving circuit, comprising a gate-charging resistor (Ra1, Ra2, and Ra3) and a constant voltage regulator (180, 182, and 184) for turning on a corresponding bypass switch (S1, S2, and S3) as well as a voltage-comparing BJT (B1, B2, and B3), an anti-clamping resistor (Rb1, Rb2, and Rb3), a current-limiting resistor (Rd1, Rd2, and Rd3), and a gate-discharging diode (D1, D2, and D3) for turning off a corresponding bypass switch (S1, S2, and S3), in control of the three switch states. A voltage divider, comprising resistors R1 and R2 in series, adds a scaled-down sample of the rectified sinusoidal input voltage $$\left(\frac{v_i \times R2}{R1 + R2}\right)$$

to the emitters of the voltage-comparing BJTs B1, B2, and B3 so that current sense signals would be compared with a sinusoidal-modulated reference voltage $$V_{REF} + \frac{v_i \times R2}{R1 + R2}$$

rather than a fixed reference voltage $V_{REF}$ to further smooth a stepping current waveform into a more sinusoidal one for getting an even higher PF and an even lower THD. Furthermore, a disturbance-blocking diode (D5, D6, and D7) is also incorporated to block a corresponding LED sub-array (G2, G3, and G4) from superimposing an undesired interference on the emitters of the voltage-comparing BJTs B1, B2, and B3 whenever a corresponding voltage-comparing BJT (B1, B2, and B3) and hence a corresponding gate-discharging diode (D1, D2, and D3) are turned on for turning off a corresponding bypass switch (S1, S2, and S3).

In this embodiment, each of the constant voltage regulators 180, 182, and 184 comprises a voltage-regulating BJT (B7, B8, and B9), a current-limiting resistor (Rv1, Rv2, and Rv3), a voltage-clamping Zener diode (Z4, Z5, and Z6), and a ceramic capacitor (C1, C2, and C3). Each of voltage-regulating BJTs (B7, B8, and B9) has its base coupled to the low-side terminal of a corresponding current-limiting resistor (Rv1, Rv2, and Rv3) (the cathode of a corresponding voltage-clamping Zener diode (Z4, Z5, and Z6)), its emitter coupled to the high-side terminal of a corresponding ceramic capacitor (C1, C2, and C3) (the high-side terminal of a corresponding gate-charging resistor (Ra1, Ra2, and Ra3)), and its collector coupled to the high-side terminal of a corresponding current-limiting resistor (Rv1, Rv2, and Rv3). In the steady state, the voltage across each ceramic capacitor (C1, C2, and C3) would be regulated by a corresponding voltage-regulating BJT (B7, B8, and B9) according to design formula $V_C=V_Z-V_{BE}$, where $V_C$, $V_Z$, and $V_{BE}$ respectively stand for the capacitor voltage, the Zener breakdown voltage, and the BJT cut-in voltage. If the voltage $V_C$ goes above its preset voltage level $V_Z$-$V_{BE}$, a corresponding voltage-regulating BJT turns off to pull it down. If the voltage $V_C$ goes below its preset voltage level $V_Z$-$V_{BE}$, a corresponding voltage-regulating BJT turns on to pull it up. The function of a constant voltage regulator is to store up a constant voltage across the two terminals of a corresponding ceramic capacitor so that the intrinsic gate-source capacitor of a corresponding enhancement-mode n-channel MOSFET could be charged up with a constant voltage source regardless of the rising or the falling edge of the rectified sinusoidal input voltage waveform, making the second half of the shaped current waveform more symmetrical to the first half of the shaped current waveform. The constant voltage regulator can be applied to any embodiment of the present invention employing enhancement-mode n-channel MOSFETs as the normally closed bypass switches.

Based on the comparison between an applied gate-source voltage $V_{GS}$ and a positive threshold voltage $V_{th}$, an enhancement-mode n-channel MOSFET would operate in its ON state ($V_{GS}>V_{th}$) due to charging of its intrinsic gate-source capacitor through a corresponding gate-charging resistor and a corresponding constant voltage regulator when a corresponding below-reference current sense signal turns a corresponding voltage-comparing BJT off, in its REGULATION state ($V_{GS}=V_{th}$) due to charging and discharging of its intrinsic gate-source capacitor through a corresponding gate-charging resistor and a corresponding constant voltage regulator as well as a corresponding voltage-comparing BJT, a corresponding anti-clamping resistor, a corresponding current-limiting resistor, and a corresponding gate-discharging diode when a corresponding at-reference current sense signal turns a corresponding voltage-comparing BJT off and on, or in its OFF state ($V_{GS}<V_{th}$) due to discharging of its intrinsic gate-source capacitor through a corresponding voltage-comparing BJT, a corresponding anti-clamping resistor, a corresponding current-limiting resistor, and a corresponding gate-discharging diode when a corresponding above-reference current sense signal turns a corresponding voltage-comparing BJT on. As such, all of the normally closed bypass switches S1, S2, and S3 would shuttle between the three switch states except for the normally closed current-regulating switch M excluding its OFF state from the three switch states.

Figure 7:
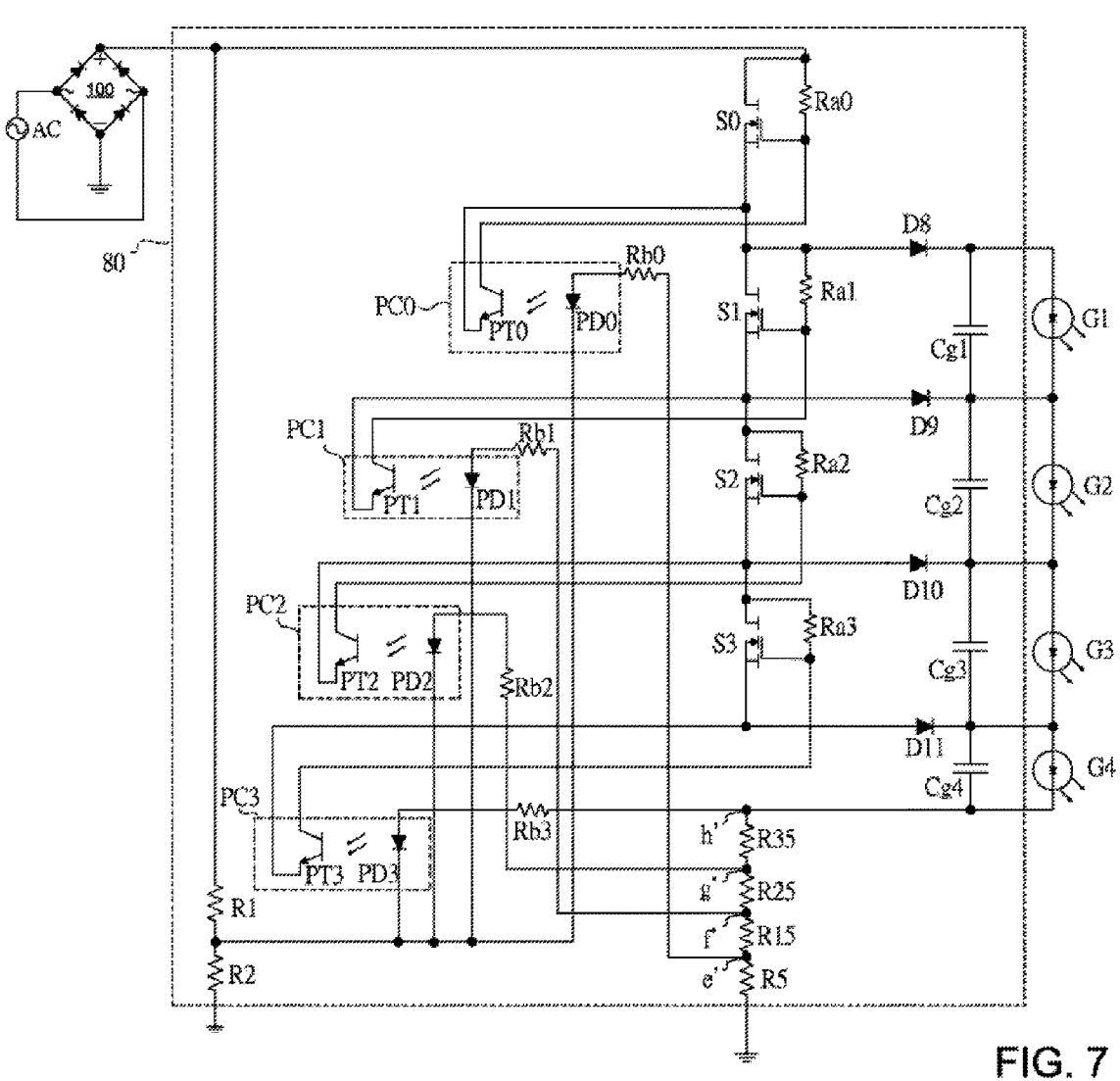
FIG. 7 illustrates a schematic diagram of an illuminating apparatus equipped with the ac-powered LED light engine shown in FIG. 1D.

FIG. 7 illustrates a schematic diagram of an illuminating apparatus 8 equipped with the ac-powered LED light engine 80 shown in FIG. 1D. The illuminating apparatus 8 comprises a rectifier 100 coupled to an AC mains, an ac-powered LED light engine 80, a string of LED sub-arrays (G1, G2, G3, and G4), and a string of current-sensing resistors (R5, R15, R25, and R35) respectively tapped off of their high-side nodes e', f', g', and h' for providing current sense signals. The ac-powered LED light engine 80 comprises a normally closed current-regulating switch S0, a string of normally closed bypass switches (S1, S2, and S3) each connected in parallel with a corresponding LED sub-array except for the bottommost LED sub-array G4 and shuttling between the three switch states according to a corresponding current sense signal, and a plurality of switch controllers each coupled between a corresponding current sense tap and a corresponding bypass switch as a feedback network and taking control of the three switch states.

The current-regulating switch S0 and each of the bypass switches S1, S2, and S3 are enhancement-mode n-channel MOSFETs, turning into a normally closed switch after the initialization process, in collocation with an adequate switch controller. Each of the switch controllers, shown as T5, T15, T25, and T35 in FIG. 1D, is a Photo Coupler (PC)-based gate-driving circuit, comprising a gate-charging resistor (Ra0, Ra1, Ra2, and Ra3) for turning on a current-regulating switch S0 and a corresponding bypass switch (S1, S2, and S3) as well as a Photo Coupler (PC0, PC1, PC2, and PC3) and an anti-clamping resistor (Rb0, Rb1, Rb2, and Rb3) for turning off a current-regulating switch S0 and a corresponding bypass switch (S1, S2, and S3), in control of the three switch states. Each Photo Coupler (PC0, PC1, PC2, and PC3) comprises a voltage-comparing Photo Diode (PD0, PD1, PD2, and PD3) and a corresponding gate-discharging Photo Transistor (PT0, PT1, PT2, and PT3).

A voltage divider, comprising resistors R1 and R2 in series, adds a scaled-down sample of the rectified sinusoidal input voltage $$\left(\frac{v_i \times R2}{R1 + R2}\right)$$

to the cathodes of the Photo Diodes PD0, PD1, PD3, and PD4 so that current sense signals would be compared with a sinusoidal-modulated reference voltage $$V_{REF} + \frac{v_i \times R2}{R1 + R2}$$

rather than a fixed reference voltage $V_{REF}$ to further smooth a stepping current waveform into a more sinusoidal one for getting an even higher PF and an even lower THD. In this embodiment, a flicker-suppressing capacitor (Cg1, Cg2, Cg3, and Cg4), coupled in parallel with a corresponding LED sub-array and functioning as an auxiliary supply of LED current, and a corresponding charge-retaining diode (D8, D9, D10, and D11), coupled between a corresponding normally closed bypass switch and a corresponding flicker-suppressing capacitor to prevent capacitor charge from being consumed by other unintended circuit components instead of a corresponding LED sub-array, are also incorporated to improve the flicker issue without any detriment to the high PF and low THD because each flicker-suppressing capacitor is merely charged up to a corresponding LED sub-array forward voltage drop and would not set up an even higher voltage barrier for the rectified sinusoidal input voltage to get over. The aforementioned flicker-suppressing capacitors, applicable to any embodiment of the present invention, could be implemented with short-life electrolytic capacitors or, even better, an equivalent M×N matrix of non-electrolytic capacitors, such as ceramic capacitors, tantalum capacitors, or solid-state capacitors for ensuring a much longer lifespan, where the row number M and the column number N are associated with the voltage rating and the current rating, respectively.

Based on the comparison between an applied gate-source voltage $V_{GS}$ and a positive threshold voltage $V_{th}$, an enhancement-mode n-channel MOSFET would operate in its ON state ($V_{GS}>V_{th}$) due to charging of its intrinsic gate-source capacitor through a corresponding gate-charging resistor when a corresponding below-reference current sense signal turns a corresponding voltage-comparing Photo Diode off, in its REGULATION state ($V_{GS}=V_{th}$) due to charging and discharging of its intrinsic gate-source capacitor through a corresponding gate-charging resistor as well as a corresponding Photo Coupler and a corresponding anti-clamping resistor when a corresponding at-reference current sense signal turns a corresponding voltage-comparing Photo Diode off and on, or in its OFF state ($V_{GS}<V_{th}$) due to discharging of its intrinsic gate-source capacitor through a corresponding Photo Coupler and a corresponding anti-clamping resistor when a corresponding above-reference current sense signal turns a corresponding voltage-comparing Photo Diode on. As such, all of the normally closed bypass switches S1, S2, and S3 would shuttle between the three switch states except for the normally closed current-regulating switch S0 excluding its OFF state from the three switch states.

To sum up, the preferred embodiments of the present invention gear up and down the number and current of excited LED sub-arrays according to the voltage level of the rectified sinusoidal input voltage for obtaining a high PF and a low THD. If further equipped with the option of disclosed flicker-suppressing capacitors, the disclosed ac-powered LED light engines could improve the flicker phenomenon while maintaining exactly the same high PF and exactly the same low THD without any deterioration.

While the present invention is susceptible to various modifications and alternative forms, specific examples thereof have been shown in the drawings and are herein described in detail. It should be understood, however, that the present invention should not be limited to the disclosed particular forms, but to the contrary, should cover all modifications, equivalents, and alternatives falling within the spirit and scope of the appended claims.

The invention claimed is:

1. An ac-powered LED light engine, coupled between a rectifier and a plurality of extrinsic LED sub-arrays, comprising:

a plurality of normally closed bypass switches, each connected in parallel with a corresponding LED sub-array except for a topmost or a bottommost LED sub-array and shuttling between three switch states: ON, REGULATION, and OFF;

a normally closed current regulator coupled to the normally closed bypass switches and used to regulate a highest LED current level near a peak of an extrinsic mains voltage;

a plurality of switch controllers each coupled to a corresponding normally closed bypass switch as a feedback network and taking control of the three switch states according to a corresponding current sense signal, wherein each of the switch controllers is a BJT-based gate-driving circuit, a shunt regulator-based gate-driving circuit, or a Photo Coupler-based gate-driving circuit for controlling the corresponding normally closed bypass switch in the three switch states; and a plurality of current-sensing resistors connected in series with the extrinsic LED sub-arrays, wherein the number of the current-sensing resistors is the same as the number of the normally closed bypass switches, and when one of the normally closed bypass switches works as a regulating bypass switch in the REGULATION state, any normally closed bypass switch on one side of the regulating bypass switch stays in the OFF state, and any normally closed bypass switch on the other side of the regulating bypass switch stays in the ON state.

2. The ac-powered LED light engine according to claim 1, wherein each of the switch controllers is coupled between a corresponding current-sensing resistor and the corresponding normally closed bypass switch, or each of the switch controllers is coupled between a corresponding sense tap and the corresponding normally closed bypass switch, wherein the corresponding sense tap is at a high-side node of the corresponding current-sensing resistor.

3. The ac-powered LED light engine according to claim 2, wherein the current-sensing resistors are connected in series, and the corresponding current sense signal is related to the corresponding sense tap, and the corresponding sense tap is related to a high-side voltage level of the corresponding current-sensing resistor.

4. The ac-powered LED light engine according to claim 1, wherein the current-sensing resistors are interspersed between the extrinsic LED sub-arrays, and the corresponding current sense signal is related to a voltage across the corresponding current-sensing resistor.

5. The ac-powered LED light engine according to claim 4, wherein a downstream one of the current-sensing resistors has a larger resistance than an upstream one.

6. The ac-powered LED light engine according to claim 4, wherein a downstream one of the current-sensing resistors has a smaller resistance than an upstream one.

7. The ac-powered LED light engine according to claim 1, wherein the normally closed current regulator is a controlled current-regulating switch or an uncontrolled current regulator, the normally closed bypass switches are enhancement-mode n-channel MOSFET or depletion-mode n-channel MOSFET, wherein the controlled current-regulating switch is a MOSFET regulated by a corresponding one of the switch controllers, and the uncontrolled current regulator comprises a MOSFET, one of the current-sensing resistors, and a BJT or a shunt regulator.

8. The ac-powered LED light engine according to claim 1, wherein each of the normally closed bypass switches is enhancement-mode n-channel MOSFET, and each of the switch controllers is a BJT-based gate-driving circuit, comprises an anti-clamping resistor, a current-limiting resistor, a gate-discharging diode, a gate-charging resistor, and a voltage-comparing BJT, for controlling the corresponding normally closed bypass switch in the three switch states, wherein the gate-charging resistor as well as a voltage-comparing BJT are together connected with a gate of the enhancement-mode n-channel MOSFET.

9. The ac-powered LED light engine according to claim 1, further comprising a plurality of constant voltage regulators for turning on a corresponding normally closed bypass switch, each of the constant voltage regulators comprising a voltage-storing capacitor, wherein the constant voltage regulator stores up a constant voltage across two terminals of a corresponding voltage-storing capacitor so that an capacitor of the corresponding normally closed bypass switch is charged up with a constant voltage source regardless of the rising or falling edge of a rectified sinusoidal input voltage waveform.

10. The ac-powered LED light engine according to claim 1, further comprising a voltage divider coupled to the rectifier to provide a scaled-down sample of a rectified sinusoidal input voltage so that the current sense signal is compared with a sinusoidal-modulated voltage, wherein the voltage divider comprises a first resistor and a second resistor connected in series.

11. The ac-powered LED light engine according to claim 1, further comprising:

a plurality of flicker-suppressing capacitors, each coupled in parallel with the corresponding LED sub-array and functioning as an auxiliary supply of LED current; and a plurality of charge-retaining diodes, each coupled between a corresponding normally closed bypass switch and a corresponding flicker-suppressing capacitor to prevent a capacitor charge from being consumed by unintended circuit components instead of the corresponding LED sub-array.

12. An integrated circuit for an illuminating apparatus, comprising the ac-powered LED light engine according to claim 1.

13. The integrated circuit for an illuminating apparatus according to claim 12, wherein the integrated circuit has a plurality of pins for external connection to the extrinsic LED sub-arrays and the current-sensing resistors, and two adjacent pins are for internal connection to two terminals of each normally closed bypass switch or two terminals of each switch controller.

14. The integrated circuit for an illuminating apparatus according to claim 13, wherein one of the pins is internally connected to a reference terminal of one of the switch controllers.

15. An illuminating apparatus, comprising:

a rectifier coupled to an AC mains for providing a rectified voltage;

an ac-powered LED light engine coupled between the rectifier and a plurality of extrinsic LED sub-arrays, wherein the ac-powered LED light engine comprises:

a plurality of normally closed bypass switches, each connected in parallel with a corresponding LED sub-array except for a topmost LED sub-array or a bottommost LED sub-array and shuttling between three switch states: ON, REGULATION, and OFF;

a normally closed current regulator coupled to the normally closed bypass switches and used to regulate a highest LED current level near a peak of an extrinsic mains voltage;

a plurality of current-sensing resistors connected in series with the extrinsic LED sub-arrays, wherein the number of the current-sensing resistors is the same as the number of the normally closed bypass switches; and a plurality of switch controllers each coupled between a corresponding current-sensing resistor or a corresponding current sense tap and a corresponding normally closed bypass switch as a feedback network and taking control of the three switch states according to a corresponding current sense signal, wherein each of the switch controllers is a BJT-based gate-driving circuit, a shunt regulator-based gate-driving circuit, or a Photo Coupler-based gate-driving circuit for controlling the corresponding normally closed bypass switch in the three switch states, and when one of the normally closed bypass switches works as a regulating bypass switch in the REGULATION state, any normally closed bypass switch on one side of the regulating bypass switch stays in the OFF state, and any normally closed bypass switch on the other side of the regulating bypass switch stays in the ON state.

16. The illuminating apparatus according to claim 15, wherein the current-sensing resistors are interspersed between the extrinsic LED sub-arrays, and the corresponding current sense signal is related to a voltage across the corresponding current-sensing resistor.

17. The illuminating apparatus according to claim 15, wherein a downstream one of the current-sensing resistors has a larger resistance than an upstream one.

18. The illuminating apparatus according to claim 15, wherein a downstream one of the current-sensing resistors has a smaller resistance than an upstream one.

19. The illuminating apparatus according to claim 15, wherein the current-sensing resistors are connected in series, and the corresponding current sense signal is related to a corresponding sense tap, and the corresponding sense tap is related to a high-side voltage level of the corresponding current-sensing resistor.

* * * * *